US008331834B2

(12) United States Patent
Koetsuka et al.

(10) Patent No.: US 8,331,834 B2
(45) Date of Patent: Dec. 11, 2012

(54) DEVELOPING UNIT, IMAGE FORMING APPARATUS INCORPORATING SAME, AND PROCESS CARTRIDGE INCLUDING SAME

(75) Inventors: Kyohta Koetsuka, Fujisawa (JP); Masayuki Ohsawa, Atsugi (JP); Yoshiyuki Takano, Haochioji (JP); Katsumi Masuda, Yokohama (JP); Yoshio Hattori, Kawasaki (JP); Yuji Suzuki, Tokyo (JP); Takamasa Ozeki, Yokohama (JP); Hiroyuki Uenishi, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 623 days.

(21) Appl. No.: 12/412,019

(22) Filed: Mar. 26, 2009

(65) Prior Publication Data

US 2009/0245889 A1 Oct. 1, 2009

(30) Foreign Application Priority Data

Apr. 1, 2008 (JP) ..... 2008-095302

(51) Int. Cl.

| | |
|---|---|
| ***G03G 21/16*** | (2006.01) |
| ***G03G 15/04*** | (2006.01) |
| ***G03G 15/08*** | (2006.01) |
| ***G03G 15/09*** | (2006.01) |

(52) U.S. Cl. ..... 399/277; 399/111; 399/119; 399/120; 399/252; 399/258; 399/265; 399/267

(58) Field of Classification Search ..... 399/111, 399/119, 120, 252, 258, 265, 267, 277
See application file for complete search history.

(56) References Cited

U.S. PATENT DOCUMENTS

| | | | | |
|---|---|---|---|---|
| 4,844,008 | A * | 7/1989 | Sakemi et al. | 399/270 |
| 5,970,294 | A | 10/1999 | Narita et al. | |
| 6,067,433 | A * | 5/2000 | Kimura et al. | 399/274 |
| 6,070,038 | A | 5/2000 | Imamura et al. | |
| 6,112,042 | A | 8/2000 | Imamura et al. | |
| 6,330,415 | B1 | 12/2001 | Imamura et al. | |

(Continued)

FOREIGN PATENT DOCUMENTS

JP 3382541 12/2002

(Continued)

OTHER PUBLICATIONS

U.S. Appl. No. 12/412,892, filed Mar. 27, 2009, Ozeki, et al.

*Primary Examiner* — David Porta
*Assistant Examiner* — Mindy Vu
(74) *Attorney, Agent, or Firm* — Oblon, Spivak, McClelland, Maier & Neustadt, L.L.P.

(57) ABSTRACT

A developing unit includable in a process cartridge and in an image forming apparatus includes a developer bearing member including a magnetic field generator and a nonmagnetic hollow member, a developer container, an agitation/conveyance member, and a developer regulating member. The magnetic field generator has first and second magnetic poles to generate respective magnetic forces for removing the developer from the developer bearing member after the developer passes the development region. A developer-releasing region releases the developer from the developer bearing member using a release force. The developer is disposed higher than a surface of the developer in the developer storing chamber. A component of a magnetic flux density of the magnetic field generated by the magnetic field generator in a direction normal to the developer-releasing region is directed to a same direction as the first and second magnetic poles across the developer-releasing region without forming a local maximum point.

23 Claims, 13 Drawing Sheets

U.S. PATENT DOCUMENTS 6,697,593 B2 2/2004 Imamura et al.
6,895,203 B2 5/2005 Ozeki et al.
6,898,406 B2 5/2005 Suzuki et al.
6,904,244 B2 6/2005 Azami et al.
7,003,235 B2 2/2006 Azami et al.
7,020,421 B2 3/2006 Enoki et al.
7,027,753 B2 4/2006 Suzuki
7,027,761 B2 4/2006 Koetsuka et al.
7,043,182 B2 5/2006 Sakai et al.
7,095,971 B2 8/2006 Ozeki et al.
7,127,199 B2 10/2006 Imamura et al.
7,189,338 B2 3/2007 Kamoi et al.
7,203,450 B2 4/2007 Kakegawa et al.
7,212,773 B2 5/2007 Sudo et al
7,283,765 B2 * 10/2007 Uratani et al. ..... 399/104
7,283,774 B2 10/2007 Ozeki et al.
7,352,983 B2 4/2008 Kamiya et al.
7,366,454 B2 4/2008 Nakamura et al.
7,466,945 B2 12/2008 Hattori
7,474,867 B2 1/2009 Ozeki et al.
8,023,855 B2 9/2011 Hattori et al.
2004/0240915 A1 * 12/2004 Nakayama ..... 399/345
2006/0228125 A1 * 10/2006 Itagaki et al. ..... 399/55
2007/0104516 A1 5/2007 Katoh et al.
2007/0127952 A1 * 6/2007 Terashima et al. ..... 399/277
2007/0170211 A1 7/2007 Hattori
2007/0297834 A1 * 12/2007 Nishida et al. ..... 399/284
2008/0008503 A1 1/2008 Imamura et al.
2008/0170891 A1 7/2008 Abe et al.
2008/0298849 A1 12/2008 Imamura et al.

FOREIGN PATENT DOCUMENTS

JP 2007-183533 7/2007

* cited by examiner

DEVELOPING UNIT, IMAGE FORMING APPARATUS INCORPORATING SAME, AND PROCESS CARTRIDGE INCLUDING SAME

CROSS-REFERENCE TO RELATED APPLICATIONS

The present invention claims priority pursuant to 35 U.S.C. §119 from Japanese Patent Application No. 2008-095302, filed on Apr. 1, 2008 in the Japan Patent Office, the contents and disclosures of each of which are hereby incorporated by reference herein in their entirety.

BACKGROUND OF THE INVENTION

1. Field of the Invention

Exemplary embodiments of the present invention generally relate to a developing unit containing a two-component developer including magnetic carrier particles and toner particles, a process cartridge including the developing unit, and an image forming apparatus, such as a copier, printer, facsimile machine, and the like, incorporating the developing unit.

2. Discussion of the Related Art

Developing units that develop toner images for electrophotographic printing generally employ either a one-component developer or a two-component developer. While the one-component developer includes toner particles only, the two-component developer includes toner particles and magnetic carrier particles.

Such developing units include a developer bearing member for bearing the developer to convey it to a development region where the developer bearing member faces an image bearing member. The developer bearing member may include a cylindrical development sleeve, for example, constituted as a hollow cylinder the interior of which contains a magnetic field generator capable of generating a magnetic field sufficient to hold the magnetic carrier particles of the developer on the exterior perimeter surface of the development sleeve. Toner particles are then electrostatically attracted to the magnetic carrier particles. As the development sleeve rotates, the toner particles attached to the magnetic carrier particles that are held on the exterior perimeter surface of the development sleeve are conveyed to the development region and then supplied to a latent image formed on a surface of the image bearing member at the development region.

The magnetic field generator has multiple magnetic poles along a direction of rotation of the development sleeve. Examples of such magnetic field generator are a roller-shaped member having magnetic pole-forming parts magnetized by external magnetic fields, a member in which multiple magnets are held by a common holding member so that each of the magnets faces a given direction, and the like.

Developer carried on the exterior perimeter surface of the development sleeve by the magnetic force generated by the magnetic field generator is conveyed in a direction of movement of the surface of the development sleeve as the development sleeve rotates.

FIG. 1 illustrates a schematic configuration of an example of a generally known developing unit 1214, and more specifically an end-on or lateral cross-sectional view thereof. Broken lines in FIG. 1 shows distribution of magnetic flux density (absolute value) in a direction normal to a surface of a developer bearing member. This conventional developing unit 1214 is hereinafter referred to as a first conventional developing unit 1214.

The first conventional developing unit 1214 includes a developer roller 1240 that serves as a developer bearing member and includes an outer development sleeve 1241 serving as a nonmagnetic hollow body and an inner magnetic roller 1247 serving as a magnetic field generator. That is, the developer roller 1240 is formed by the hollow cylindrical development sleeve 1241 made of some non-magnetic material surrounding the magnetic roller 1247, so as to hold developer on an exterior perimeter surface of the development sleeve 1241 by a magnetic force generated by the magnetic roller 1247.

The developing unit 1214 further includes a developer container 1249 for containing developer, screw-shaped agitation/conveyance members 1242 and 1243 for agitating and conveying the developer axially along a direction of a rotary shaft of the development sleeve 1241, and a developer regulating member 1246 for regulating the thickness of a layer of developer carried on the development sleeve 1241.

The developer container 1249 is separated in a first container (i.e., a developer storing chamber) 1249A and a second container (i.e., a developer agitating chamber) 1249B. The first container 1249A is positioned lower than the development sleeve 1241 and extends in an axial direction of the development sleeve 1241. The second container 1249B is disposed adjacent the first container 1249A and also extends in the axial direction of the development sleeve 1241. The first container 1249A includes the agitation/conveyance member 1242 and the second container 249B includes the agitation/conveyance member 1243 that rotates in a direction indicated by arrow "R1" in FIG. 1. The agitation/conveyance member 1243 conveys the developer to a downstream end of the first container 1249A, which corresponds to a far or distal side in FIG. 1. The developer is then conveyed to the second container 1249B through a space or opening where the first container 1249A and the second container 1249B meet and are communicably coupled together. In the second container 1249B, the agitation/conveyance member 1242 conveys the developer to a downstream end of the second container 1249B, which corresponds to a near or proximal side in FIG. 1. Thus, the developer is circulated or recirculated within the developer container 1249.

Toner is generally supplied from a toner bottle, not shown, to the second container 1249B for replenishment, that is, replacing an amount of toner consumed for development. During conveyance of the developer, the magnetic force generated by the magnetic roller 1247 scoops up, or attracts, the developer contained in the first container 1249A, which is then supplied to the development sleeve 1241. Then, the thickness of the layer of thus-supplied developer on the development sleeve 1241 is regulated by the developer regulating member 1246, and the developer passes the development region facing an image bearing member 1012, and returns to the developer container 1249.

The magnetic roller 1247 includes five magnetic poles, which are a magnetic pole S1 for development, a magnetic pole N1 for conveyance, a magnetic pole S2 for developer release at an upstream portion, a magnetic pole S3 for developer release and attraction, and a magnetic pole N2 for regulation. Where the magnetic poles S1, S2, and S3 are implemented as south poles, for example, the magnetic poles N1 and N2 are implemented as north poles, for example.

As the development sleeve 1241 rotates in a direction indicated by arrow "R2" in FIG. 1, the developer held on the development sleeve 1241 is conveyed and then passes by positions facing the magnetic pole S3, the magnetic pole N2, the magnetic pole S1, the magnetic pole N1, and the magnetic pole S2, in this order. After passing the development region, most of the toner particles of the developer are consumed for developing toner images. Therefore, the developer is released or removed from the development sleeve 1241 to return to the developer container 1249 so that new developer can be constantly attracted to the development sleeve 1241. This action is important to provide stable development ability. That is, this action is important to prevent developer carryover or residual retention, in which developer with fewer toner particles remains on the development sleeve 1241 even post-development to be conveyed continuously to the development region again.

When the magnetic pole S2 and the magnetic pole S3 having an identical polarity are disposed adjacent to each other, a developer-releasing region P is formed between the magnetic poles S2 and S3 in the developing unit 1214 shown in FIG. 1 that exerts a release force to cause the developer carried by the development sleeve 1241 to move away from the development sleeve 1241 and toward the first container 1249A of the developer container 1249. That is, the magnetic force generated by the magnetic poles S2 and S3 releases the developer from the development sleeve 1241 in the developer-releasing region P, so that the developer is removed from the development sleeve 1241 and mixed with the developer in the first container 1249A of the developer container 1249.

The first conventional developing unit 1214 shown in FIG. 1 has a polarity inversion point Q on the development sleeve 1241, located within a region extending from the developer-releasing region P to a developer-regulating region where the developer regulating member 1246 regulates the developer scooped up to the development sleeve 1241 by the magnetic force generated by the magnetic pole S3. Developer density is high around the polarity inversion point Q because the magnetic force exerted on the developer is relatively strong and a magnetic flux density in a direction normal to the development sleeve 1241 is too small to form a magnetic brush. Accordingly, even if some developer remains on the development sleeve 1241 without being removed therefrom in the developer-releasing region P, such residual developer can be released or scraped off by the high-density developer held in the vicinity of the polarity inversion point Q. For this reason, this conventional developing unit 1214 can effectively prevent developer carryover.

However, such a continuous high-density state of developer in the vicinity of the polarity inversion point Q imposes a constant mechanical stress on the developer particles, causing them to deteriorate. Therefore, an amount of torque to drive the agitation/conveyance member 1243 of the first container 1249A has to be increased and the agitation/conveyance member 1243 has to be more rigid in strength and larger in size, which can lead to an increase both in cost and in size of the first conventional developing unit 1214.

Further, since the developer is subject to a great amount of stress, a speed of progression of implantation of external additives from the toner into the surface of each carrier particle and abrasion of a surface layer film of each carrier particle, both of which are undesirable, may be accelerated. These actions easily can degrade toner chargeability and powder flowability of developer, which in turn can make it difficult to maintain good image quality over an extended period of time. Since the powder properties of developer can degrade easily, an amount of developer conveyed to the development region may decrease especially when the ability of the development sleeve 1241 to convey developer has deteriorated, and good image quality cannot be maintained for an extended period of time.

FIG. 2 illustrates a schematic configuration of another example of a generally known developing unit 1314. This known developing unit 1314 is referred to as a second conventional developing unit 1314. The second conventional developing unit 1314 reduces an amount of stress on the developer. The second conventional developing unit 1314 shown in FIG. 2 is similar to the first conventional developing unit 1214 shown in FIG. 1, except that a single magnetic pole capable of performing removal, attraction, and regulation of developer simultaneously is provided in the vicinity of a developer regulating member 1346, instead of the known magnetic poles S3 and N2 shown in FIG. 1.

Similar to the first conventional developing unit 1214, the second conventional developing unit 1314 includes a developer roller 1340 that serves as a developer bearing member and is disposed facing the image bearing member 1012, and includes an outer development sleeve 1341 serving as a non-magnetic hollow body and an inner magnetic roller 1347 serving as a magnetic field generator. The development unit 1314 further includes a developer container 1349 for containing developer, screw-shaped agitation/conveyance members 1342 and 1343, and the developer regulating member 1346 for regulating the thickness of layer of developer carried on the development sleeve 1341 that rotates in a direction indicated by arrow "R2" in FIG. 2. The developer container 1349 is separated into a first container (i.e., a developer storing chamber) 1349A and a second container (i.e., a developer agitating chamber) 1349B.

According to the second conventional developing unit 1314 shown in FIG. 2, the developer that cannot be scooped up by the magnetic force of the magnetic pole N3 may fall to the agitation/conveyance screw 1343 (which rotates in a direction indicated by arrow "R1" in FIG. 2) in a region upstream from the developer-regulating region where the developer regulating member 1346 regulates the thickness of layer of developer in a direction of conveyance of developer by the development sleeve 1341 of the developing roller 1340. (Hereinafter, "upstream" and "downstream" indicate an upstream side and downstream side from a given specific position in a direction of conveyance of developer by the development sleeve 1341, respectively.) Such an arrangement prevents a large body of developer from accumulating in the region, thereby reducing the stress on the developer.

Although not disclosed in the first conventional developing unit 1214 and the second conventional developing unit 1314, the developer tends to accumulate in an area from at least a downstream part of the developer-releasing region P that is located upstream from the developer-regulating region to the developer-regulating region in the developing units 1214 and 1314. Whit this arrangement, in the second conventional developing unit 1314, while the developer released from the development sleeve 1341 in an upstream part of the developer-releasing region P may fall onto the agitation/conveyance screw 1343, the developer remaining on the development sleeve 1341 after passing the downstream part of the developer-releasing region P may be taken in developer accumulated in the area to be released or removed therefrom. That is, similar to the first conventional developing unit 1214 shown in FIG. 1, the developer remaining on the development sleeve 1341 can be removed or scraped off by the developer in the developer container 1349. For this reason, the second conventional developing unit 1314 can effectively prevent the carryover of developer.

However, the above-described configuration, in which the developer in the developer container 1349 is used for removing the developer remaining on the development sleeve 1341, may impose a certain amount of mechanical stress on the developer when the developer on the development sleeve 1341 is scraped therefrom. In light of market demands to reduce stress on the developer as much as possible, it is also desired to reduce the above-described stress on the developer when scraping the developer off the development sleeve 1341.

Consequently, the present inventors have conducted extensive research designed to eliminate stress on the developer when scraping it off a development sleeve, and as a result have developed a developing unit 1414 as shown in FIG. 3.

As illustrated in FIG. 3, the developing unit 1414 includes a developing roller 1440, a developer container 1449, and a developer regulating member 1446. The developing roller 1440 serves as a developer bearing member, includes an outer development sleeve 1441 serving as a nonmagnetic hollow body and an inner magnetic roller 1447 serving as a magnetic field generator, and is disposed facing the image bearing member 1012. The developer container 1449 includes two container sections, a first container 1449A and a second container 1449B. The first container 1449A includes a screw-shaped agitation/conveyance member 1443, which rotates in a direction indicated by arrow "R1" in FIG. 3, and the second container 1449B also includes screw-shaped agitation/conveyance member 1442, which rotates in a direction indicated by arrow "R2" in FIG. 3.

In the developing unit 1414, the developing roller 1440 is shifted upward in relation to the developer container 1449 as shown in FIG. 3 so that the developer-releasing region P on the development sleeve 1441 does not contact the top surface of developer in the developer storing chamber 1449A when the development sleeve 1441 rotates in a direction indicated by arrow "R3" in FIG. 3. With this configuration of the developing unit 1414, even though some developer might remain in the developer-releasing region P on the development sleeve 1441, that developer is not scraped off the development sleeve 1441 by the developer stored in the developer storing chamber 1449A, and therefore is not stressed due to scraping.

However, the inventors have found that the developing unit 1414 can cause the following problems.

As described above, the configuration of the developing unit 1414 prevents the developer in the developer-releasing region P on the development sleeve 1441 from contacting the developer stored in the developer storing chamber 1449A. With this configuration, the developer released from the development sleeve 1441 in the developer-releasing region P is subject to the action of a rotative force or torque of the development sleeve 1441 and a release force of the magnetic force generated by the magnetic poles, and consequently flies into the developer container 1449 to be taken and mixed into the developer therein.

Adjacent to and on the downstream side of the developer-releasing region P, a developer-attracting region R is provided to attract the developer with the magnetic force generated by the magnetic pole N3 for developer release, attraction, and regulation. The developer released in the developer-releasing region P, especially an end part thereof, is also subjected to the torque of the development sleeve 1441 and consequently moves toward a downstream side of the developer-releasing region P, which can cause the developer to fly toward the developer-attracting region R while moving away from the development sleeve 1441. Therefore, the developer flying toward the developer-attracting region R after being released from the development sleeve 1441 is affected by the magnetic force generated by the magnetic pole N3 and reattaches to the development region by being taken in with other developer attracted to the developer-attracting region R or by directly adhering or attaching to the developer-attracting region R. As with the above-described developer carryover, such developer reattachment hinders, stable image development, but with this difference:

Whereas the developer carryover causes unevenness in image density with streaks that may extend in a circumferential direction of the development sleeve 1441, the developer reattachment causes unevenness in image density with spots. However, both the developer carryover and the developer reattachment can degrade image quality.

Further, the developer in the downstream part of the developer-releasing region P contacts the surface of the developer stored in the developer storing chamber 1349A and can act as a wall to protect the developer released from the upstream part of the developer-releasing region P, so that the developer may not be taken by the developer in the developer attracting region R and/or may directly adhere to the developer attracting region R, for example.

Further, in the developing unit shown in FIG. 3, the developer remaining on the development sleeve 1441 cannot be scraped off by the developer stored in the developer storing chamber 1449A before the developer is conveyed to the developer attracting region R. Consequently, developer carryover can occur easily.

SUMMARY OF THE INVENTION

Exemplary aspects of the present invention have been made in view of the above-described circumstances.

Exemplary aspects of the present invention provide a novel developing unit that can effectively decrease mechanical stress on developer in a developer-regulating region in which a height or thickness of the developer is regulated by the developer regulating member and can prevent developer carryover and developer reattachment with respect to a development sleeve.

Another exemplary aspect of the present invention provide an image forming apparatus that incorporates the above-described novel developing unit.

Yet another exemplary aspect of the present invention provide a process cartridge that includes the above-described novel developing unit.

In one exemplary embodiment, a novel developing unit includes a developer bearing member including a magnetic field generator and a nonmagnetic hollow body containing the magnetic field generator for bearing a two-component developer including magnetic carrier particles and toner particles on an exterior perimeter surface thereof by a magnetic force generated by the magnetic field generator, a developer container including a developer storing chamber to store the two-component developer, an agitation/conveyance member to convey the two-component developer in an axial direction of the developer bearing member while agitating the two-component developer, and a developer regulating member to regulate a thickness of layer of the two-component developer held on the developer bearing member. The two-component developer conveyed in the developer container is attracted by the magnetic force exerted by the magnetic field generator to the developer bearing member, is regulated by the developer regulating member, then passes through a development region of the developer bearing member facing an image bearing member, and returns to the developer container. The magnetic field generator includes first and second magnetic poles with an identical polarity disposed adjacent to each other and downstream from the development region in a direction of rotation of the developer bearing member to generate respective magnetic forces for removing the two-component developer from the developer bearing member after the developer passes through the development region. The second magnetic pole is disposed downstream from the first magnetic pole in a direction of conveyance of developer by the developer bearing member and proximate to the developer regulating member to generate a magnetic force to attract the two-component developer from the developer storing chamber in the developer container for forming a magnetic brush of the two-component developer on the developer bearing member regulated by the developer bearing member. The developer bearing member includes a developer-releasing region to release the two-component developer from the developer bearing member using a release force corresponding to magnetic forces generated by the first and second magnetic poles. The developer is disposed higher than a top surface of the two-component developer stored in the developer storing chamber so that the developer-releasing region on the developer bearing member remains separated from the top surface of the two-component developer in the developer storing chamber as the developer bearing member rotates. A component of a magnetic flux density of the magnetic field generated by the magnetic field generator in a direction normal to the developer-releasing region on the developer bearing member is directed to a same direction as the first and second magnetic poles across the developer-releasing region without forming a local maximum point.

The magnetic field generator may be disposed such that the release force exerted on the two-component developer in the developer-releasing region on the developer bearing member has two local maximum points, and a release force at a local minimum point between the two local maximum points is at least 50% as strong as a release force at the local maximum point.

The magnetic field generator may be disposed such that the release force exerted on the two-component developer in the developer-releasing region on the developer bearing member has a single local maximum point.

The developer-releasing region on the developer bearing member may include a first point where the magnetic flux density in a normal direction of the first magnetic pole reaches a maximum on the developer bearing member in the direction of conveyance of developer thereon, a second point where the magnetic flux density in a normal direction of the second magnetic pole reaches a maximum on the developer bearing member in the direction of conveyance of developer thereon, and a third point where the magnetic flux density in a direction normal to the developer bearing member reaches a minimum on the developer bearing member. The magnetic field generator may be disposed such that the third point is located closer to the second point than to the first point from a center point between the first point and the second point.

A speed of surface movement of the nonmagnetic hollow body may be 350 mm/sec or greater.

Multiple elliptic dents may be formed randomly on the exterior perimeter surface of the nonmagnetic hollow body of the developer bearing member.

The volume average particle diameter of each of the magnetic carrier particles may be 20 μm to 50 μm.

Further, in one exemplary embodiment, an image forming apparatus includes an image bearing member to bear an image on a surface thereof, and the above-described developing unit. The developing unit is disposed facing the image bearing member to convey and adhere the two-component developer to the image to develop a toner image to be transferred from the image bearing member onto a recording medium.

Further, in one exemplary embodiment, a process cartridge, detachably attachable to an image forming apparatus, includes an image bearing member to bear an image on a surface thereof, and the above-described developing unit. The image bearing member and the developing unit are integrally supported by the process cartridge. The developing unit is disposed facing the image bearing member to convey and adhere the two-component developer to the image to develop a toner image to be transferred from the image bearing member onto a recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
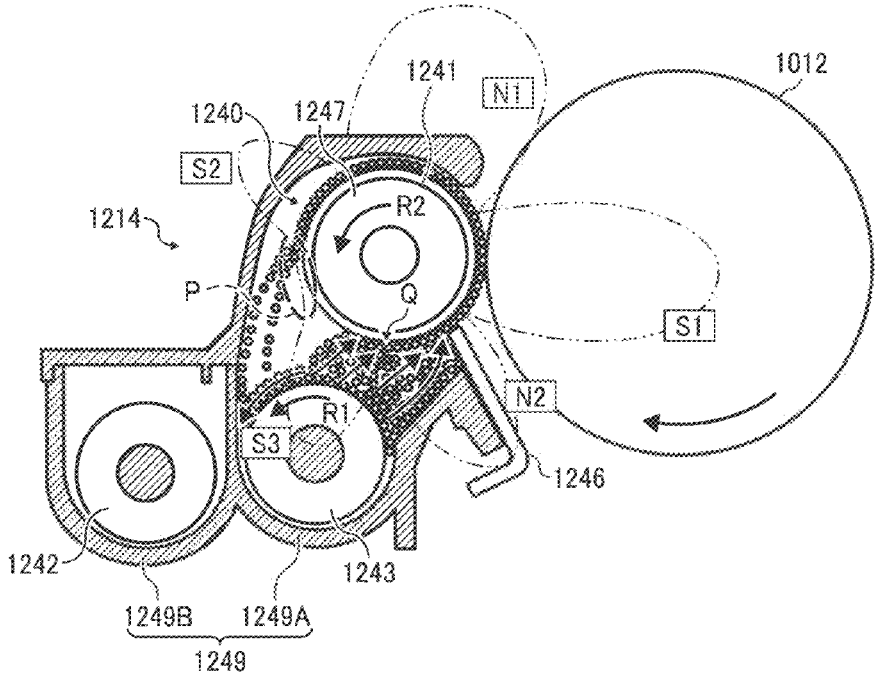
FIG. 1 BACKGROUND ART
FIG. 1 is a cross-sectional view of a schematic configuration of an example of a generally known developing unit.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 4:
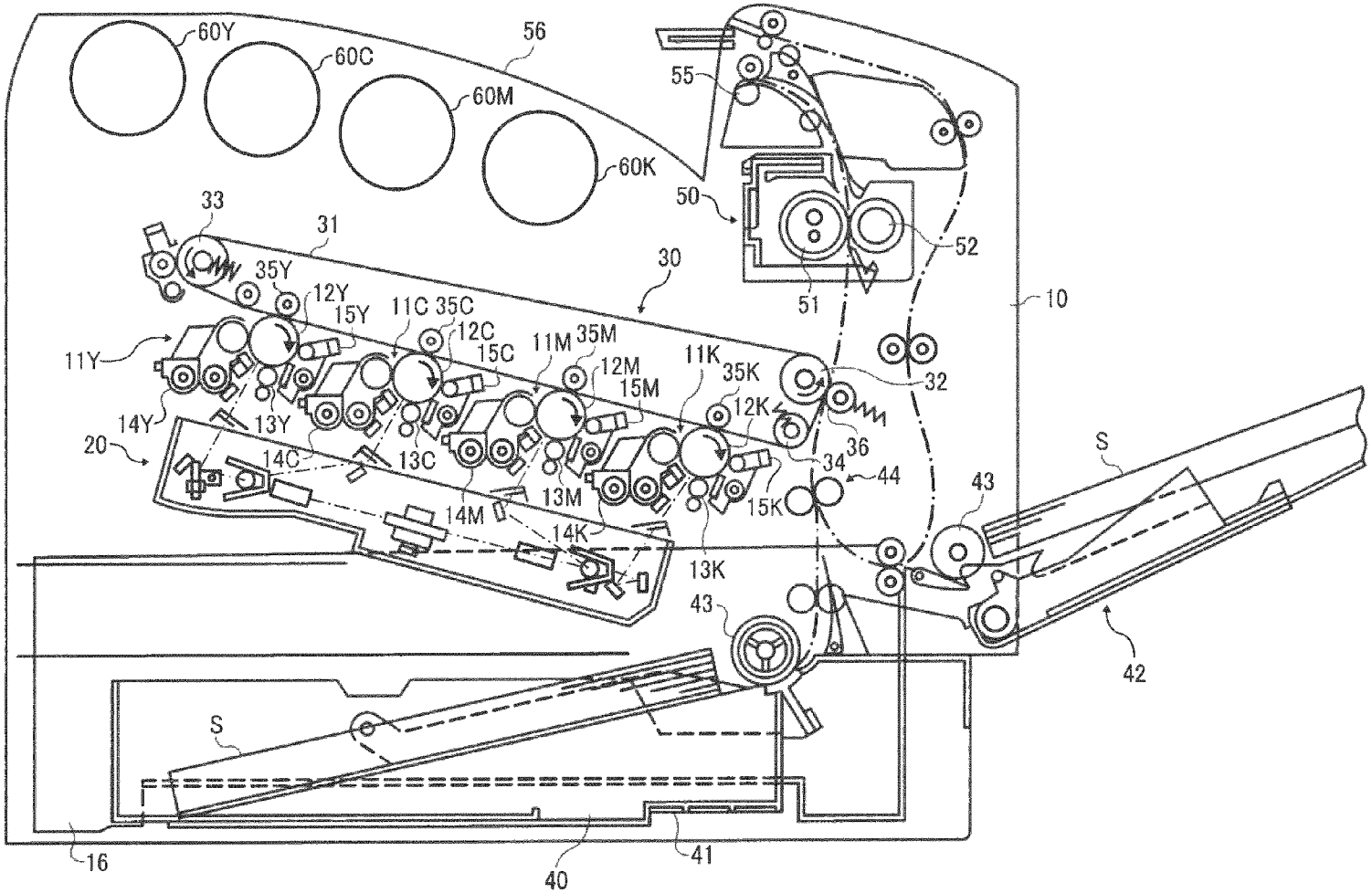
FIG. 4 is a cross-sectional view of a schematic configuration of an image forming apparatus according to an exemplary embodiment of the present invention.

Now, referring to FIG. 4, a description is given of a schematic configuration of an image forming apparatus 1 according to an exemplary embodiment of the present invention.

The image forming apparatus 1 can be any of a copier, a printer, a facsimile machine, a plotter, and a multifunction printer including at least one of copying, printing, scanning, plotter, and facsimile functions. In this non-limiting example embodiment, the image forming apparatus 1 functions as a printer for electrophotographically forming a toner image based on image data on a recording medium (e.g., a recording sheet).

Reference symbols "Y", "C", "M", and "K" represent yellow color, cyan color, magenta color, and black color, respectively.

The image forming apparatus 1 includes a main body 10, an image forming unit 11, an optical writing unit 20, an intermediate transfer unit 30, a sheet feed unit 40, and a fixing unit 50.

The image forming unit 11 includes four image forming units 11Y, 11C, 11M, and 11K that serve as process cartridges and are detachably attachable to an image forming station provided in the main body 1. The image forming units 11Y, 11C, 11M, and 11K include respective consumable image forming components to perform image forming operations for producing respective toner images with toners of different colors of yellow (Y), cyan (C), magenta (M), and black (K). The image forming units 11Y, 11C, 11M, and 11K are separately disposed at positions having different heights in a stepped manner and are detachably provided to the image forming apparatus 1 so that each of the image forming units 11Y, 11C, 11M, and 11K can be replaced at once at an end of its useful life. The image forming units 11Y, 11C, 11M, and 11K have similar structures and functions, except that respective toners are of different colors, which are yellow, cyan, magenta and black toners, the discussion below will be applied to any of the image forming units 11Y, 11C, 11M, and 11K when the units and components are described without suffixes.

The image forming unit 11 includes a photoconductor drum 12, a charging unit 12, a developing unit 14, and a cleaning unit 15. As previously described, the image forming units 11Y, 11C, 11M, and 11K have similar configurations to each other, except for different toner colors, the photoconductor drum 12 corresponds to any of photoconductor drums 12Y, 12C, 12M, and 12K, the charging unit 13 corresponds to any of charging units 13Y, 13C, 13M, and 13K, the developing unit 14 corresponds to any of developing units 14Y, 14C, 14M, and 14K, and the cleaning unit 15 corresponds to any of cleaning units 15Y, 15C, 15M, and 15K.

The photoconductor drum 12 serves as an image bearing member to form an electrostatic latent image on a surface thereof.

The charging unit 13 uniformly charges the photoconductor drum 12.

The developing unit 14 develops an electrostatic latent image formed on the photoconductor drum 12.

The cleaning unit 15 cleans the photoconductor drum 12 by removing residual toner remaining thereon.

The photoconductor drum 12, the charging unit 13, and the cleaning unit 15 are integrally mounted on the image forming unit 11.

The optical writing unit 20 emits multiple laser light beams each of which irradiates the surface of the photoconductor drum 12 to form an electrostatic latent image.

The intermediate transfer unit 30 includes an intermediate transfer belt 31, multiple rollers 32, 33, and 34, a primary transfer roller 35, and a secondary transfer roller 36.

The intermediate transfer belt 31 serves as an intermediate transfer member and is spanned around and extended by the multiple rollers 32, 33, and 34.

The primary transfer roller 35 corresponds to any of primary transfer rollers 35Y, 35C, 35M, and 35K, and transfers the toner image held on the photoconductor drum 12 onto the intermediate transfer belt 31.

The secondary transfer roller 36 transfers the toner image on the intermediate transfer belt 31 onto a transfer sheet S as a recording medium.

The sheet feed unit 40 includes a sheet feed cassette 41, a manual sheet feed tray 42, a sheet feed roller 43, and a pair of registration rollers 44.

The sheet feed roller 43 feeds the transfer sheet S either from the sheet feed cassette 41 or from the manual sheet feed tray 42 and conveys the transfer sheet S to a secondary transfer region.

The pair of registration rollers 44 stops and feeds the transfer sheet S conveyed by the sheet feed roller 43.

The fixing unit 50 includes a fixing roller 51 and a pressure roller 52.

The fixing roller 51 and the pressure roller 52 fix the toner image to the transfer sheet S by applying heat and pressure, respectively.

Toner bottles 60Y, 60C, 60M, and 60K are disposed above and detachably attachable to the main body 10, separated from the image forming units 11Y, 11C, 11M, and 11K. Each of the toner bottles 60Y, 60C, 60M, and 60K includes toner of a corresponding single color to be conveyed to a toner supply port 145 (see FIG. 5).

Next, image forming operations using the above-described configuration of the image forming apparatus 1 are described.

For example, the surface of the photoconductor drum 12Y is uniformly charged by the charging unit 13Y of the image forming unit 11Y for forming yellow toner image, and exposed to light by the optical writing unit 20 to form an electrostatic latent image thereon. The developing unit 14Y develops the electrostatic latent image to a yellow toner image by attracting yellow toner to the surface of the photoconductor drum 12Y. The yellow toner image formed on the photoconductor drum 12Y is transferred onto the intermediate transfer belt 31 by action of the primary transfer roller 35Y. After the primary transfer, the cleaning unit 15Y cleans the surface of the photoconductor drum 12Y for a subsequent image forming operation.

Residual toner collected by the cleaning unit 15Y is conveyed and stored in a wasted toner collection bottle 16 that is disposed at a lower left position in FIG. 4 and slidably detachable and attachable in a direction of a shaft of the photoconductor drum 12Y. The wasted toner collection bottle 16 is also detachably attachable to the main body 10 to be replaceable when a reservoir therein becomes full.

The above-described operations are repeated for forming a cyan toner image, a magenta toner image, and a black toner image in the image forming units 11C, 11M, and 11K, respectively. The cyan toner image, the magenta toner image, and the black toner image are sequentially transferred onto the intermediate transfer belt 31 to be overlaid on the yellow toner image previously formed thereon, and thus a color toner image is formed.

When the transfer sheet S is conveyed from one of the sheet feed cassette 41 and the manual sheet feed tray 42 to the secondary transfer region, the secondary transfer roller 36 causes the color toner image formed on the intermediate transfer belt 31 to be transferred onto the transfer sheet S. The transfer sheet S having the color toner image thereon is conveyed to the fixing unit 50 so as to fix the toner image to the transfer sheet S by applying heat and pressure to the transfer sheet S at a fixing nip portion formed between the fixing roller 51 and the pressure roller 52. The transfer sheet S is then discharged by a discharging roller 55 to a sheet discharging tray 56 arranged at an upper position of the image forming apparatus 1.

Figure 5:
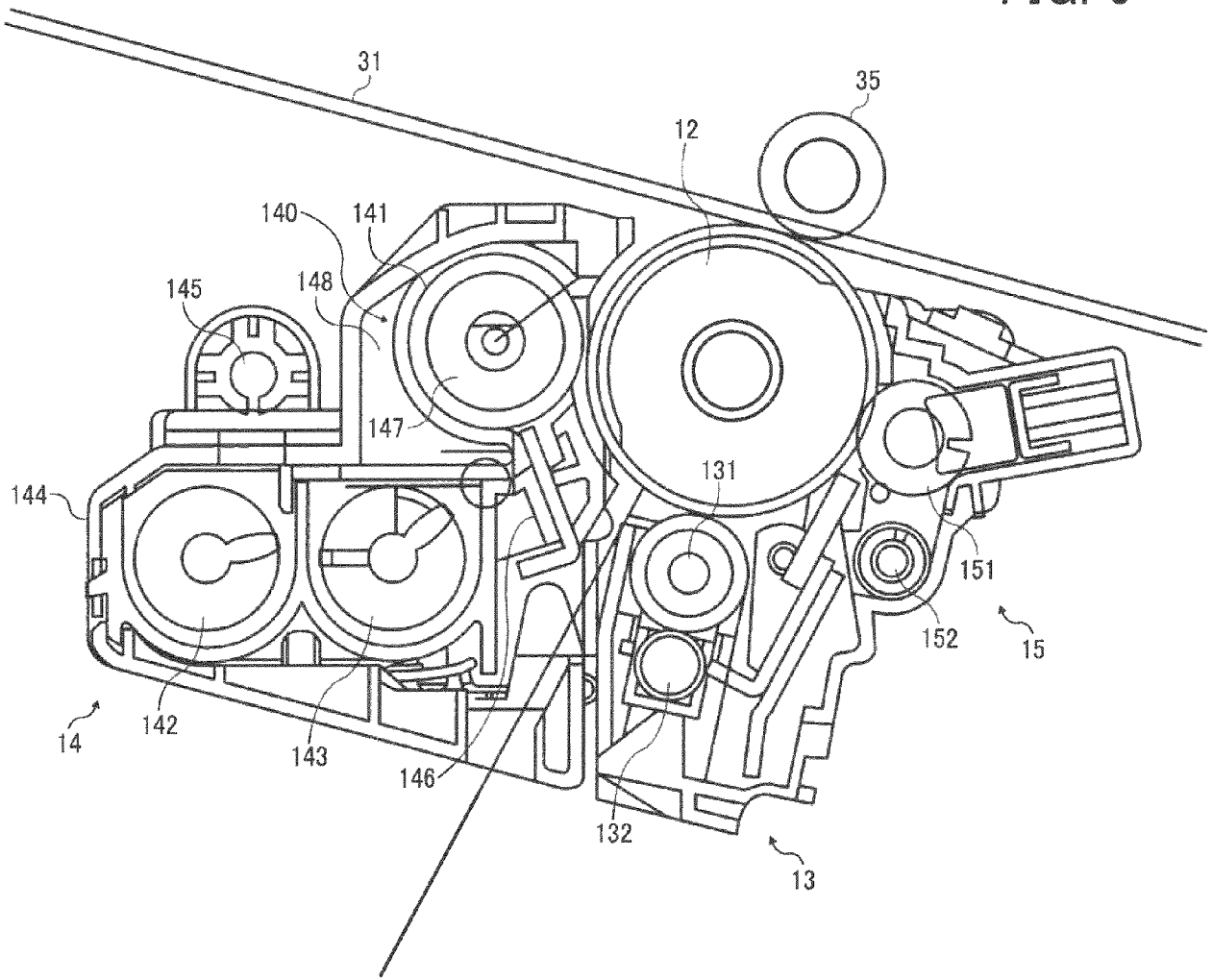
FIG. 5 is a cross-sectional view of an image forming unit included in the image forming apparatus of FIG. 4.

Next, referring to FIG. 5, a detailed description is given of the image forming unit 11, which can be applied to any of the image forming units 11Y, 11C, 11M, and 11K.

Since the image forming units 11Y, 11C, 11M, and 11K have similar structures and functions, except that respective toners are of different colors, which are yellow, cyan, magenta and black toners, the discussion below will be applied to any of the image forming units 11Y, 11C, 11M, and 11K and the image forming components incorporated therein.

FIG. 5 illustrates a schematic configuration of the image forming unit 11. In FIG. 5, the charging unit 13 includes a charge roller 131 and a cleaning roller 132, and the cleaning unit 15 includes a cleaning brush 151, a cleaning blade 152, and a toner collection coil 153, not shown in FIG. 5.

The charging roller 131 has a surface, which is cleaned by the cleaning roller 132.

The cleaning brush 151 and the cleaning blade 152 contact the photoconductor drum 12 to clean a surface thereof.

The toner collection coil 153 conveys toner removed from the photoconductor drum 12 by the cleaning brush 151 and the cleaning blade 152 toward the wasted toner collection bottle 16.

The developing unit 14 includes a developing roller 140, a nonmagnetic outer development sleeve 141, conveyance screws 142 and 143, a casing 144, the toner supply port 145, a doctor blade 146, an inner magnetic roller 147, and a seal member 148. These members and components are housed and supported by the casing 144.

The developing roller 140 serves as a developer bearing member and includes the nonmagnetic development sleeve 141 and the magnetic roller 147.

The nonmagnetic development sleeve 141 serves as a nonmagnetic hollow body constituted as a hollow cylinder of the developing roller 140 and is disposed to face the photoconductor drum 12 in the development region while rotating in a counterclockwise direction as shown in FIG. 5 and holding two-component developer including magnetic carrier particles and toner particles. Hereinafter, the two-component developer is referred to simply as "developer".

The magnetic roller 147 is fixedly disposed in the interior of the hollow development sleeve 141. The magnetic roller 147 serves as a magnetic field generator and contains multiple magnets or magnetic poles in a circumferential direction of the development sleeve 141.

The conveyance screws 142 and 143 are disposed to face the development sleeve 141 of the developing roller 140. The conveyance screws 142 and 143 serve as agitation conveyance member to mix and agitate magnetic carrier contained in the developing unit 14 and toner supplied through the toner supply port 145 and convey the carrier and toner in an axial direction of the photoconductor drum 12 according to respective directions of conveyance of the developer by the conveyance screws 142 and 143.

The doctor blade 146 serves as a developer regulating member to form a doctor gap G with the development sleeve 141 for regulating the thickness of a layer of developer held on the surface of the development sleeve 141. The doctor blade 146 is supported at a slot of the casing 144.

Figure 10:
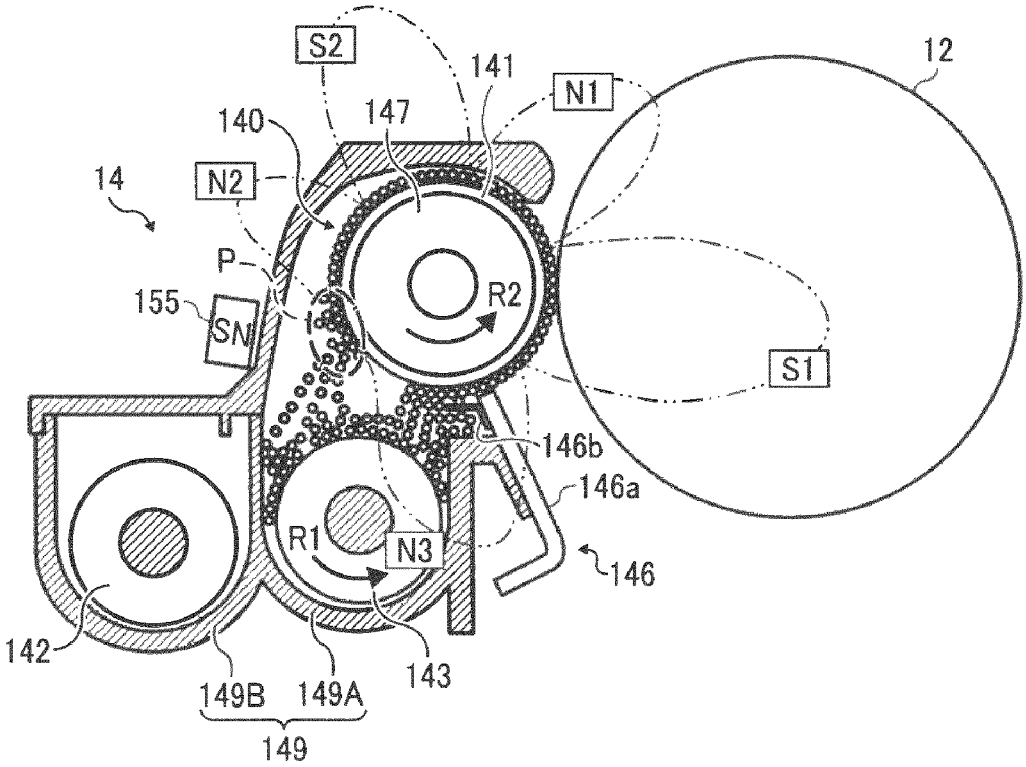
FIG. 10 is a cross-sectional view illustrating the developing unit of FIG. 5, indicating a distribution of a magnetic flux density in a direction to a development sleeve.

Specifically, the doctor blade 146 according to the exemplary embodiment includes a doctor base body 146*a* (see FIG. 10) and a doctor supporting member 146*b* (see FIG. 10).

The doctor base body 146*a* is constituted as a nonmagnetic member for mainly regulating an amount of developer to be conveyed to the development region to a constant amount, and therefore receives a pressure of developer when regulating the developer. To withstand the pressure of developer, the doctor base body 146*a* generally maintains a certain amount of strength or hardness. For example, the doctor base body 146*a* is required to have a thickness from approximately 1.5 mm to approximately 2.0 mm, which corresponds to a distance of movement of the surface of the development sleeve 141 in a direction of conveyance of developer by the development sleeve 141 and the leading edge thereof, which is an end portion facing the surface of the development sleeve 141, is required to have straightness of approximately 0.05 mm to the surface of the development sleeve 141.

The doctor supporting member 146*b* is constituted as a magnetic member to mainly increase an amount of toner charge to be conveyed to the development region. The doctor supporting member 146*b* is normally much thinner than the doctor base body 146*a*, for example, includes a tubular or flat metal of approximately 0.2 mm. To obtain constant toner chargeability in an axial direction of the development sleeve 141, the doctor supporting member 146*b* may need to maintain a positional relation with the surface of the development sleeve 141 across the development sleeve 141 in its axial direction with accuracy. Thus, the doctor supporting member 146*b* is attached to the doctor base body 146*a* by spot welding or swaging.

Figure 6:
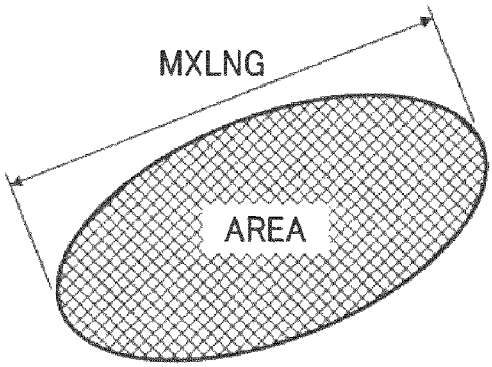
FIG. 6 is a drawing of a toner having an "SF-1" shape factor.
Figure 7:
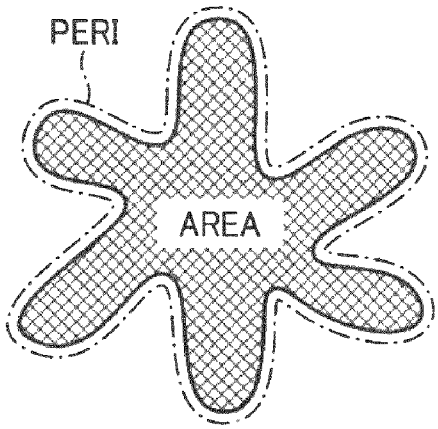
FIG. 7 is a drawing of a toner having an "SF-2" shape factor.

Referring to FIGS. 6 and 7, shapes of a toner particle are described.

It is preferable high roundness toner having an average roundness equal to or above 0.93 is adopted for use in the developing unit of the image forming apparatus 1. That is, it is known that the diameter of a toner particle is reduced to enhance image quality. However, when decreasing the diameter of a toner particle, a distribution of a conventional pulverized toner may become broad. Therefore, it is generally known to use a method for obtaining high image quality by increasing a circularity of toner by performing a polymerization reaction and making a sharp particle diameter distribution. The toner of this exemplary embodiment is typically prepared by dispersing a mixture of toner constituents including at least a polyester prepolymer having an isocyanate group, a polyester, a colorant, and a release agent in an aqueous medium in the presence of a particulate resin to perform a polymerization reaction (such as elongation and/or crosslinking). The toner constituents as described above are dissolved in an organic solvent to prepare a toner constituent solution. The dispersion is reacted with an elongation agent and/or a crosslinking agent in the aqueous medium. By using such a particulate resin, various effects can be achieved, for example, the pulverization process may not be required, the resource saving is promoted, the resultant toner has good charging ability and a sharp particle diameter distribution, and a toner shape control for changing the circularity of toner can be easily performed.

A shape factor "SF-1" of the toner used in the image forming apparatus may be in a range from approximately 100 to approximately 180, and the shape factor "SF-2" of the toner is in a range from approximately 100 to approximately 180.

Referring to FIG. 6, the shape factor "SF-1" is a parameter representing the roundness of a particle. The shape factor "SF-1" of a toner particle is calculated by the following Equation 1:

$$SF1=\{(MXLNG)^2/\text{AREA}\}\times(100\pi/4) \qquad \text{Equation 1,}$$

where "MXLNG" represents the maximum major axis of an elliptical-shaped figure obtained by projecting a toner particle on a two dimensional plane, and "AREA" represents the projected area of elliptical-shaped figure.

When the value of the shape factor "SF-1" is 100, the particle has a perfect spherical shape. As the value of the "SF-1" increases, the shape of the particle becomes more elliptical.

Referring to FIG. 7, the shape factor "SF-2" is a value representing irregularity (i.e., a ratio of convex and concave portions) of the shape of the toner particle. The shape factor "SF-2" of a particle is calculated by the following Equation 2:

$$SF2=\{(PERI)^2/\text{AREA}\}\times(100\pi/4) \qquad \text{Equation 2,}$$

where "PERI" represents the perimeter of a figure obtained by projecting a toner particle on a two dimensional plane.

When the value of the shape factor "SF-2" is 100, the surface of the toner is even (i.e., no convex and concave portions). As the value of the "SF-2" increases, the surface of the toner becomes uneven (i.e., the number of convex and concave portions increase).

In this exemplary embodiment of the present invention, toner images are sampled by using a field emission type scanning electron microscope (FE-SEM) S-800 manufactured by HITACHI, LTD. The toner image information is analyzed by using an image analyzer (LUSEX3) manufactured by NIREKO, LTD.

As a toner particle has a higher roundness, the toner particle is more likely to make a point-contact with the surface of the photoconductor drum 12 or another toner particle on the photoconductor drum 12. In this case, the adhesion force between these toner particles is weak, thereby making the toner particles highly flowable. Also, while weak adhesion force between the round toner particle and the photoconductive drum 12 enhances the transfer rate. Therefore, when the shape factor "SF-1" of the shape factor "SF-2" of the toner used in the image forming apparatus 1 exceeds 180, the transfer rate may decrease, which is not preferable.

Preferably, the toners according to an exemplary embodiment of the present invention have an volume average particle diameter of 3 μm to 8 μm, the ratio of (Dv/Dn) is 1.00 to 1.40, wherein Dv means a volume average particle diameter and Dn means a number average particle diameter. Further, narrower particle diameter distribution may lead to uniform distribution of toner charge and thus high quality images with less fog of background, and also higher transfer rate.

Further, the developing unit 14 according to the exemplary embodiment of the present invention can employ the magnetic carrier having a volume-based average particle diameter in a range of from 20 μm to 50 μm. By using the above-described magnetic carrier, the graininess in image can be enhanced, and therefore a good image quality can be obtained.

Generally, a gap between the development sleeve 141 and the photoconductor drum 12 (hereinafter, referred to as a "development gap") and a diameter of magnetic carrier particle significantly affect the image quality. In the developing unit 14 according to this exemplary embodiment having the development gap, for example, in a range of from 0.1 mm to 0.4 mm, when the diameter of magnetic carrier particle is in a range of from 20 μm to 50 μm, a most preferable image quality can be obtained and the side effect is reduced.

If the development gap between the development sleeve 141 and the photoconductor drum 12 is too small, the electrical field between the development sleeve 141 and the photoconductor drum 12 becomes too strong, resulting in a problem referred to as carrier adhesion that the magnetic carrier particles are moved onto the surface of the photoconductor drum 12.

On the other hand, if the development gap is too large, the electrical field becomes small. For this reason, the developing effect is decreased, and the edge effect of the electrical field is increased in the edge of image portion, and thus it may become difficult to obtain an even image.

Further, if the diameter of magnetic carrier particle is too small, the size of magnetization of one carrier particle is reduced. Therefore, the magnetic binding force received from the magnetic roller 147 of the developing roller 140 is reduced, and the carrier adhesion is easily caused.

If the diameter of magnetic carrier particle is too large, the magnetic field between the magnetic carrier particles and an electrostatic latent image formed on the photoconductor drum 12 becomes sparse, and thus it may also become difficult to obtain an even image.

The volume-based average particle diameter distribution of the magnetic carrier can be determined by using measurement instruments for measuring particle diameter distribution of a toner particle, for example, a Coulter Counter (trademark) Model TA-II or a Coulter Multisizer II (trademark) (both available from Beckman Coulter, Inc.). More specifically, the volume-based average particle diameter distribution can be determined by the following process. Initially, a dispersant, i.e., 0.1 ml to 5 ml of surfactant (preferably alkylbenzene sulfonate) is added to 100 ml to 150 ml of electrolytic solution. The electrolytic solution is approximately 1% aqueous solution of NaCl of extra pure sodium chloride, such as ISOTON-II (trade name, available from Beckman Coulter, Inc.). Next, 2 mg to 20 mg of a test sample is added to the electrolytic solution. The electrolytic solution suspending the test sample is dispersed by an ultrasonic disperser for about 1 minute to 3 minutes. Thereafter, toner particles, or volume and number of toner are measured by the above-mentioned apparatus with an aperture of 100 μm, and the volume distribution and number distribution are calculated. The volume-average particle diameter (Dv) and the number-average particle diameter (Dn) are then determined from the determined distributions.

Further, the magnetic carrier according to an exemplary embodiment of the present invention includes a resin coating film surrounding a core of a magnetic member. The resin coating film contains charge control agent to add to a carrier-coating material of cross-linked substance of a melamine resin and a thermoplastic resin such as an acrylic resin, and the like. By using the magnetic carrier, an effect for absorbing impact or shock to reduce abrasion and retaining large carrier particles by an enhanced adhesion force and an effect for preventing impact to the resin coating film and cleaning of toner spent, in a balanced manner. Thus, the usable life of magnetic carrier can be longer, and film abrasion and toner spent can be avoided.

Figure 8:
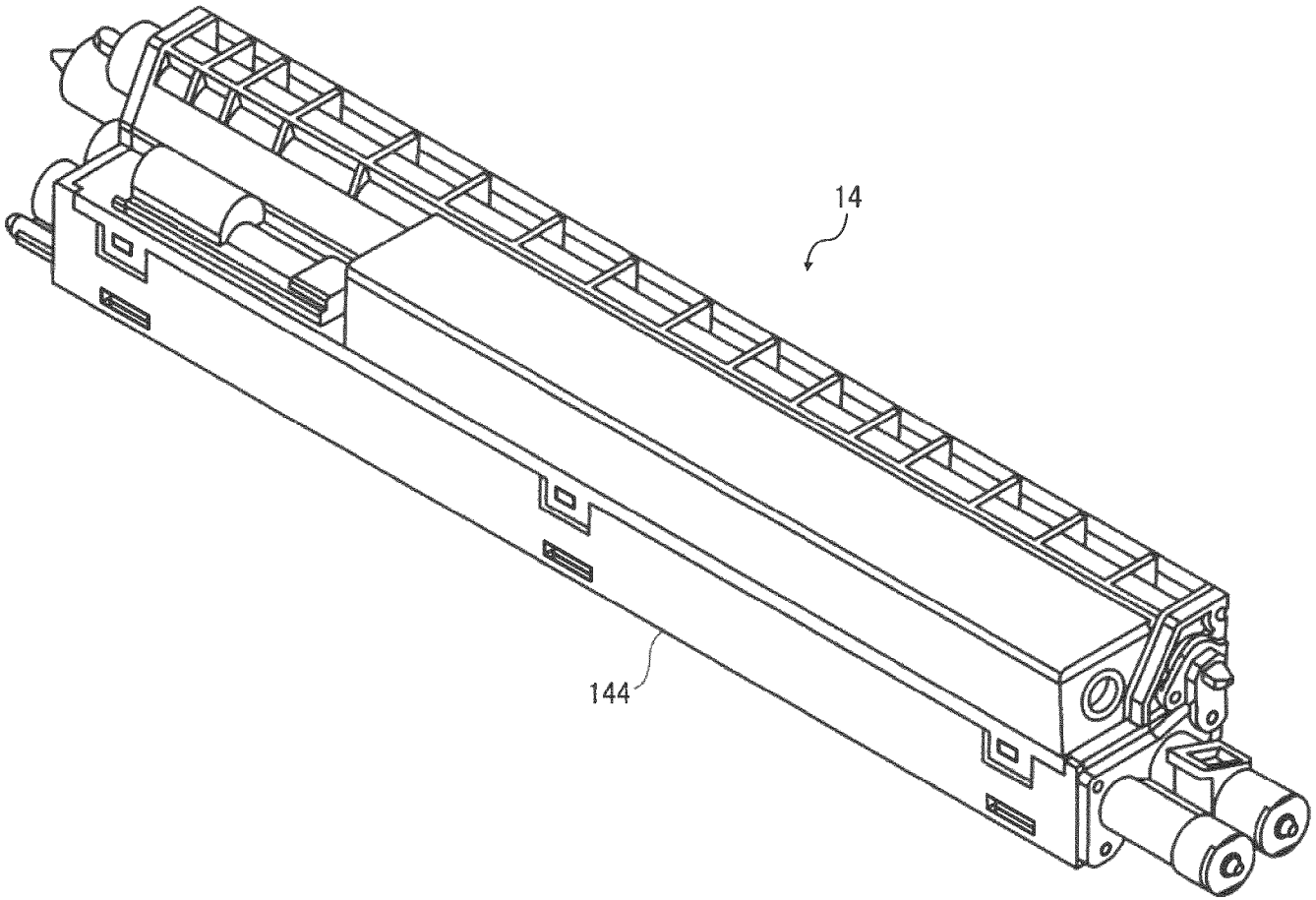
FIG. 8 is a perspective view illustrating a developing unit included in the image forming unit of FIG. 5.
Figure 9:
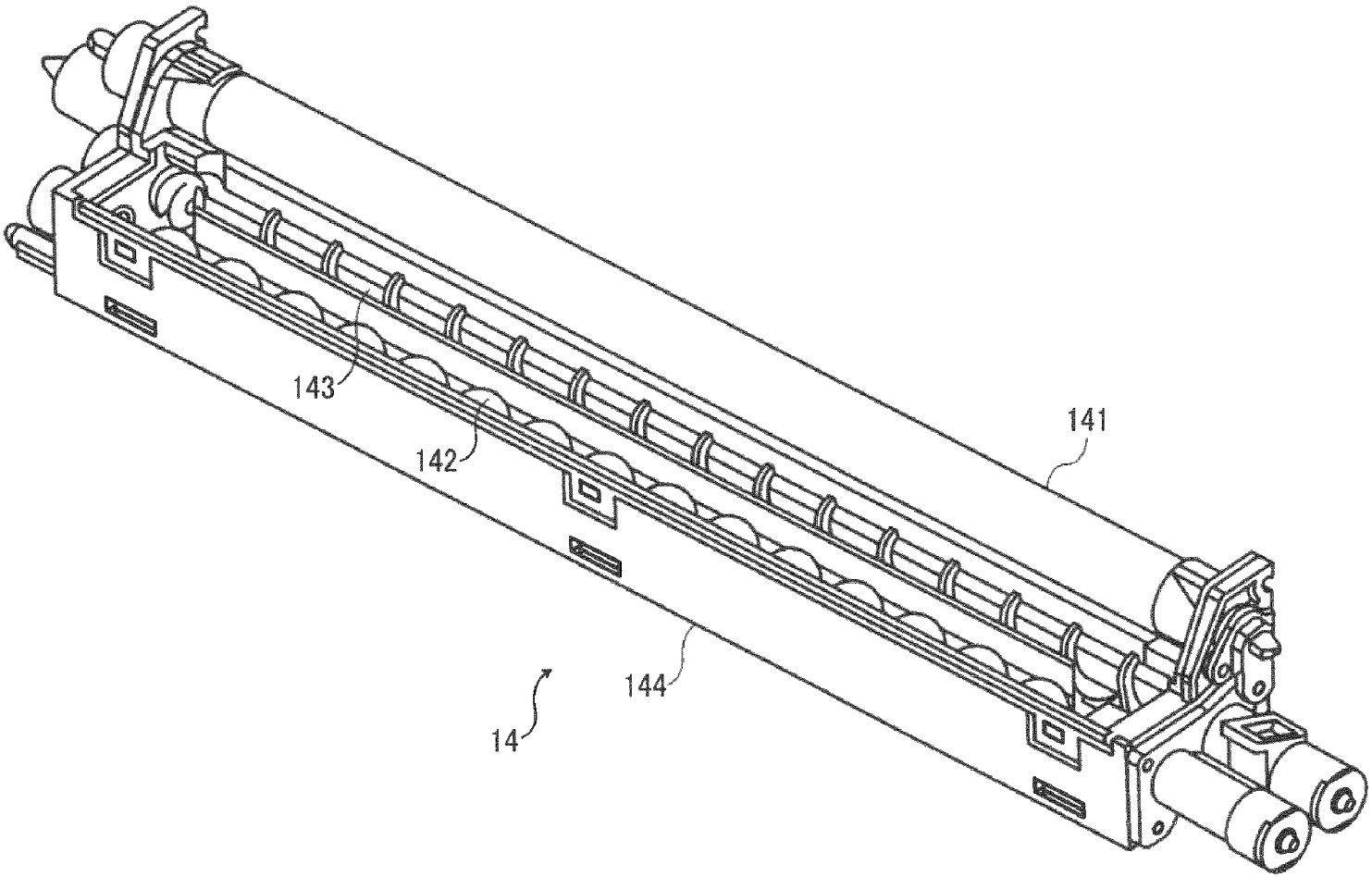
FIG. 9 is another perspective view illustrating the developing unit of FIG. 5 with a top part of the developing unit open.

Next, referring to FIGS. 8 to 10, descriptions are given of the developing unit 14 according to the exemplary embodiment of the present invention. FIG. 8 is a perspective view illustrating the developing unit 14. FIG. 9 is a perspective view illustrating the developing unit 14 with the top part of the casing 144 open so as to show the inside of the developer container 149 of the developing unit 14. FIG. 10 is a cross-sectional view illustrating the developing unit 14, with a chain double-dashed line indicating a distribution of a magnetic flux density in a direction to the surface of the development sleeve 141 (absolute value).

The magnetic roller 147 in the developing unit 14 is a cylindrical member of resin with magnetic powder surrounded by an exterior perimeter surface magnetized by multiple magnetic poles (i.e., multiple magnets). A diameter of the magnetic roller 147 is approximately 18 mm. The magnetic poles formed on the magnetic roller 147 face the photoconductor drum 12 at the nip portion and are arranged in a counterclockwise direction in FIG. 10 (i.e., in a direction the development sleeve 141 conveys the developer), starting from a magnetic pole S1 for development (hereinafter, referred to as "magnetic pole S1"), magnetic poles N1 and S2 for conveyance (hereinafter, referred to as "magnetic pole N1" and "magnetic pole S2", respectively), magnetic pole N2 for upstream developer empty magnetic pole (hereinafter, referred to as "magnetic pole N2"), and magnetic pole N3 for developer empty, attraction, and regulation (hereinafter, referred to as "magnetic pole N3").

The magnetic roller 147 is an integrally formed member. However, the magnetic roller 147 can be formed with multiple magnet members per magnetic pole around the axis thereof. For the integrally formed magnetic roller 147 used in this exemplary embodiment, it is preferable to use a roller in which magnetic powder is dispersed to resin such as ethylene ethyl acrylate and nylon (registered trade name). Preferable examples of the magnetic powder used in this exemplary embodiment include ferrites such as strontium ferrite and the like or rare earth magnetic particles such as NdFeB, SmFeN, and the like.

By contrast, the development sleeve 141 is development sleeve 141 is a hollow member of some nonmagnetic material. Examples of preferable material of the development sleeve 141 are aluminum, stainless steel, and the like, for workability, cost, and durability. More preferably, multiple elliptic dents are formed randomly on the outer perimeter surface of the development sleeve 141 so that the development sleeve 141 has multiple elliptic concave parts randomly on the outer perimeter surface thereof. Thus, the development sleeve 141 may have an uneven surface with multiple concave parts at random pitches, thereby presenting slippage of developer without adhering to the surface of the development sleeve 141 while the development sleeve 141 is rotating. Consequently a chain of developer beads rises on each concave part so that multiple chains of risen developer beads can form a thick magnetic brush. Further, the concave parts may not likely to abrade easily. Therefore, a good image with stable quality can be obtained without generating uneven image over an extended period of time. Such concave parts are preferably formed by using a conventional blasting, for example, colliding or bumping media of relatively large-shaped cut wires of short metallic wires to the surface of a pipe-shaped development sleeve.

It is a known method to form grooves or uneven convex and concave portions on the surface of the development sleeve by sand blasting, bead blasting, etc. so as to convey the developer easily. Specially, color image forming apparatuses typically use a development sleeve having convex and concave portions on the surface thereof by blasting for high image quality. Non-smooth processing such as groove forming, blasting, and the like prevents a decrease in image density generated due to slippage and accumulation of developer on the surface of the development sleeve 141 while the development sleeve 141 is rotating at high speed.

A magnet 155 is provided in the vicinity of the developing roller 140. Details of the magnet 155 will be described later.

The casing 144 provides separate space corresponding to a developer container 149 in the developing unit 14. The developer container 149 includes a developer storing chamber 149A, an agitation chamber 149B, and conveyance screws 142 and 143.

The developer storing chamber 149A is disposed below the development sleeve 141, extending in an axial direction of the development sleeve 141. The developer storing chamber 149A includes the conveyance screw 143 that rotates in a direction indicated by arrow "R1" in FIG. 10.

The agitation chamber 149B is disposed adjacent and separate from the developer storing chamber 149A, extending in the axial direction of the development sleeve 141. The agitation chamber 149B includes the conveyance screw 142.

The conveyance screw 143 conveys the developer to a downstream end (far or distal side in FIG. 10) of the developer storing chamber 149A, so as to transfer the developer into the agitation chamber 149B. The developer in the agitation chamber 149B is conveyed by the conveyance screw 142 to a downstream end (near or proximal side in FIG. 10) of the agitation chamber 149B. The developer is then conveyed to the developer storing chamber 149A again. Thus, the developer is circulated in the developer container 149.

New or fresh toner for supplementing toner consumed for development is supplied through the toner supply port 145 to the developer in the agitation chamber 149B. While traveling in the developer storing chamber 149A, the developer is attracted to the development sleeve 141 by the action of magnetic force exerted by the magnetic pole N3 of the magnetic roller 147. Then, the developer on the development sleeve 141 is regulated by the doctor blade 146, passes the development region while facing the photoconductor drum 12, and returns to the developer container 149.

In an exemplary embodiment, the developer attracted from the developer storing chamber 149A to the development sleeve 141 by the action of the magnetic force generated by the magnetic pole N3 is conveyed in a counterclockwise direction in FIG. 10 as the development sleeve 141 rotates in a direction indicated by arrow "R2" in FIG. 10. After the doctor blade 146 has regulated the developer to have a given thickness of a layer of developer on the development sleeve 141, the developer rises to form the magnetic brush by the magnetic force generated by the magnetic pole S1 in the development region. The developer raised by the electric field for development adheres to the electrostatic latent image formed on the surface of the photoconductor drum 12 to develop to a toner image. The post-development developer is conveyed as the development sleeve 141 rotates while being held on the development sleeve 141 by the magnetic forces in the order of the magnetic pole N1, the magnetic pole S2, and the magnetic pole N2. Then, the developer is removed or released from the development sleeve 141 by the action of a repulsive magnetic force or release force generated between the magnetic pole N2 and the magnetic pole N3 and falls onto the developer storing chamber 149A of the developer container 149.

The magnetic forces are calculated based on the following equations:

$$Fr=G\times(Hr\times(\partial Hr/\partial r)+Hr\times(\partial H\theta/\partial r)); \text{ and}$$

$$F\theta=G\times(1/r\times Hr\times(\partial Hr/\partial\theta)+1/r\times(Hr\times\partial H\theta/\partial\theta)$$

where "Fr" represents a normal component of a magnetic force to the surface of a development sleeve (hereinafter, referred to as "normal component of the magnetic force Fr"), "Fθ" represents a tangential component of a magnetic force to the surface of a development sleeve (hereinafter, referred to as "tangential component of the magnetic force Fθ"), "Hr" represents a normal component of a magnetic flux density to the surface of a development sleeve, "Hθ" represents a tangential component of a magnetic flux density to the surface of a development sleeve, "r" represents a radius for calculation, and "G" represents a constant ($7.8\times10^{-15}$).

In the following description, when the normal component of the magnetic force Fr indicates a positive number, the magnetic force is exerted to move the magnetic carrier away from the development sleeve 141. By contrast, when the normal component of the magnetic force Fr indicates a negative number, the magnetic force is exerted to move the magnetic carrier toward the development sleeve 141.

Further, in the following description, an "upstream side" indicates an upstream side in a direction of conveyance of development on the development sleeve 141, a "downstream side" indicates a downstream side in a direction of conveyance of development on the development sleeve 141, and a "developer conveyance direction" indicates a direction of conveyance of development held on the surface of the development sleeve 141, unless otherwise specifically indicated.

In the exemplary embodiment, the magnetic pole N3 that is disposed adjacent the magnetic pole N2 is disposed in the vicinity of the doctor blade 146, as shown in FIG. 10. The magnetic pole N2 and the magnetic pole N3 have an identical polarity to each other. According to this arrangement, the developer attracted to the development sleeve 141 may not be affected by a polarity inversion point in the magnetic field before the doctor blade 146 regulates the thickness of a layer of developer on the development sleeve 141. Therefore, different from the configuration of the conventional developing unit having the polarity inversion point (i.e., the polarity inversion point Q) as shown in FIG. 1, the configuration of the developing unit 14 shown in FIG. 10 can reduce mechanical stress on the developer at the upstream side from the doctor blade 146 in the developer conveyance direction.

Further, the development sleeve 141 has a developer-releasing region P on a given area thereon, where the magnetic poles N2 and N3 generate a magnetic force that acts as a release force to cause the developer held on the development sleeve 141 to move away from the development sleeve 141 or toward a direction opposite to the surface of the development sleeve 141. In the exemplary embodiment, the developer-releasing region P is located so as not to be held in contact with (a top surface of) developer stored in the developer storing chamber 149A.

Figure 2:
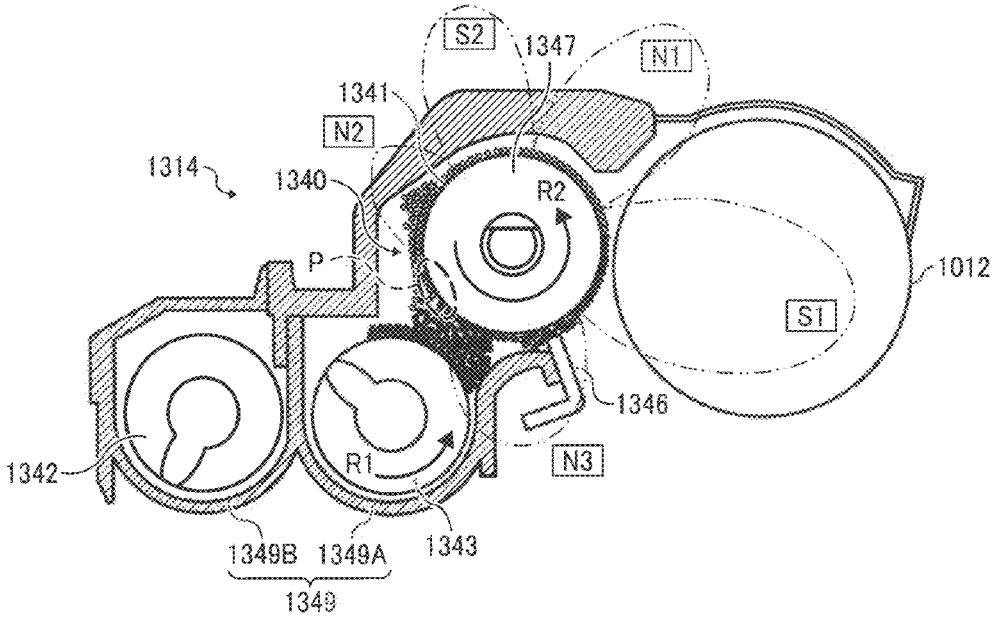
FIG. 2 BACKGROUND ART
FIG. 2 is a cross-sectional view of a schematic configuration of a modified example of a generally known developing unit.

The development sleeve 141 of the developing roller 140 is disposed at a position higher than the development sleeve 1341 in the conventional developing unit 1314 of FIG. 2, so that the developer-releasing region P on the development sleeve 141 may not contact the surface of the developer in the developer storing chamber 149A while the development sleeve 141 is rotating. With this configuration, even though some amount of the developer still remains on the development sleeve 141, the residual developer on the development sleeve 141 may not be scraped off by the developer in the developer storing chamber 149A to be removed from the development sleeve 141. Therefore, the developing unit 14 can reduce an amount of stress on the developer, compared to the conventional developing unit 1314 shown in FIG. 2 in which the developer-releasing region P is designed to be held in contact with the developer in the developer storing chamber 1349A.

By contrast, in the developing unit 14 according to the exemplary embodiment, the developer of a hard magnetic brush formed by the magnetic force generated by the magnetic pole N3 may not be subject to the above-described shearing forces, and thus the stress on the developer can be further reduced.

In the conventional developing unit 1314 of FIG. 2, the developer in the developer storing chamber 1349A has a function for scraping off the developer from the development sleeve 1341. However, the developing unit 14 according to an exemplary embodiment of the present invention is not designed for holding the developer in the developer storing chamber 149A in contact with the developer-releasing region P. Therefore, if the developer is not sufficiently removed from the development sleeve 141 while passing the developer-releasing region P, the developer on the development sleeve 141 may remain thereon continuously.

In addition to the above-described function, the developer in the developer storing chamber 1349A in the conventional developing unit 1314 of FIG. 2 acts as a wall to prevent the developer released from the development sleeve 1341 in the developer-releasing region P from being attracted to a developer-attracting region, not shown, by the magnetic force generated by the magnetic pole N3 or being attracted by other developer that is attracted toward the developer-attracting region. The developer-attracting region is located downstream from and adjacent the developer-releasing region P (in the direction of rotation of the development sleeve 141) where the magnetic force generated by the magnetic pole N3 is exerted to scoop up the developer.

However, since the developer does not act as or not form such a wall in the exemplary embodiment of the present invention, if the developer released from the developer-releasing region P is not moved away from the developer-attracting region sufficiently or remains in the vicinity of the developer-attracting region, the developer can adhere to the development sleeve 141 again.

With the above-described reasons, the developing unit 14 according to the exemplary embodiment of the present invention is designed such that the normal component of the magnetic flux density Hr in the developer-releasing region P on the development sleeve 141 is directed to the north pole or N-pole direction, which is a positive direction same as the direction of the magnetic pole N2 and the magnetic pole N3, across the developer-releasing region P and does not form the local maximum point. By so doing, the release force can be effectively directed to the developer adhering to the development sleeve 141 in the developer-releasing region P. Details of this action will be described later. According to the above-described release force, the developing unit 14 according to the exemplary embodiment of the present invention can effectively reduce the developer carryover and developer reattachment on the development sleeve 141 even if the developer in the developer storing chamber 149A does not scrape off the developer in the developer-releasing region P or act as the wall to prevent developer reattachment to the development sleeve 141.

Figure 11:
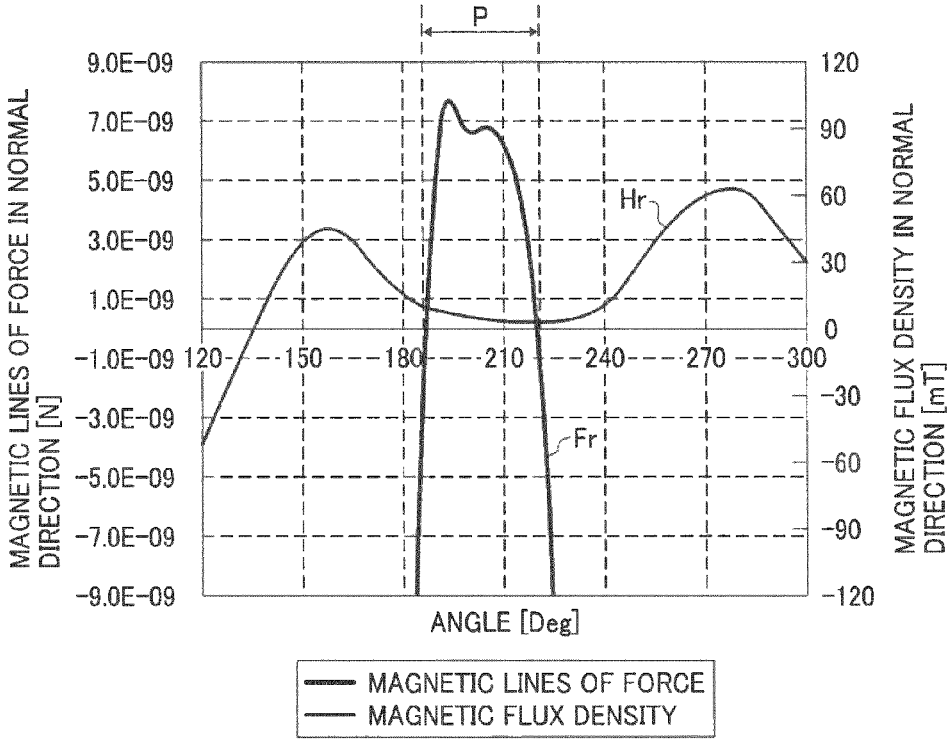
FIG. 11 is a graph showing a relation between a magnetic flux density in a direction normal to a developer releasing region on the development sleeve and a magnetic force in a direction normal to the surface of the development sleeve in the developing unit according to an exemplary embodiment of the present invention.
Figure 12:
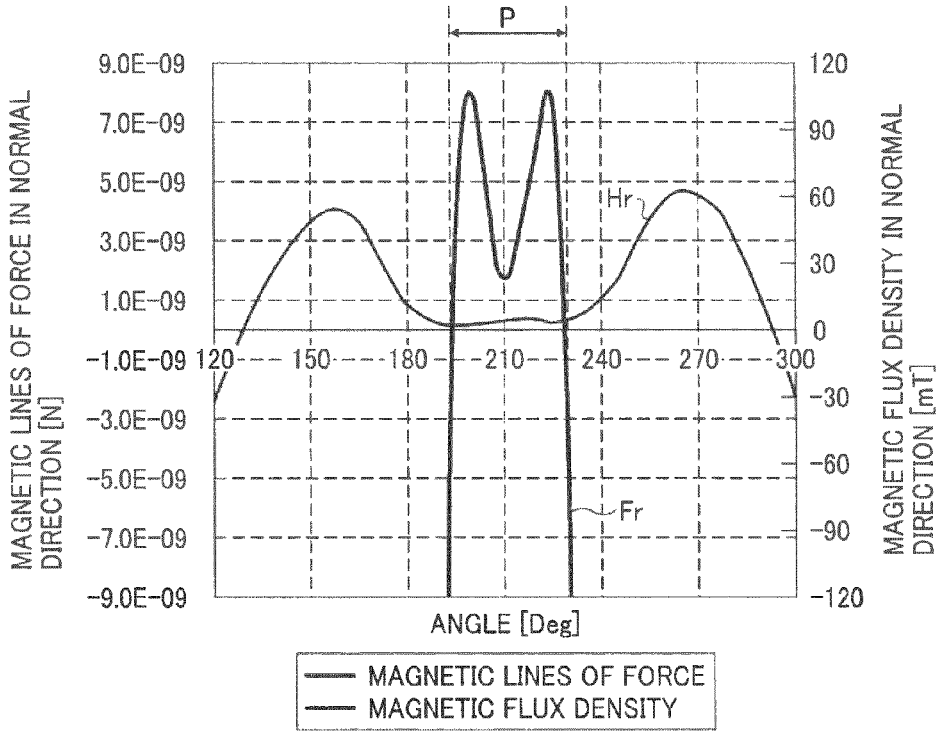
FIG. 12 is a graph showing a relation between a magnetic flux density in a direction normal to a developer releasing region on the development sleeve and a magnetic force in a direction normal to the surface of the development sleeve in a comparative developing unit.

Next, descriptions are given of a relation between normal components of the magnetic flux density Hr and normal components of the magnetic force Fr with respect to respective surfaces of two different development sleeves, referring to graphs shown in FIGS. 11 and 12.

FIG. 11 is a graph showing a relation between the normal component of the magnetic flux density Hr to the surface of the development sleeve 141 around the developer-releasing region P and the normal component of the magnetic force Fr to the surface of the development sleeve 141 of the developing unit 14 according to the exemplary embodiment of the present invention. The normal component of the magnetic flux density Hr is indicated by a thin line and the normal component of the magnetic force Fr is indicated by a thick line in the graph of FIG. 11.

Similarly to the graph of FIG. 11, FIG. 12 is a graph showing a relation between the normal component of the magnetic flux density Hr to the surface of a development sleeve around a developer-releasing region P of a developing unit according to a comparative example (the conventional developing unit 1414 of FIG. 3) and the normal component of the magnetic force Fr to the surface of the development sleeve of the developing unit according to the comparative example. The normal component of the magnetic flux density Hr is indicated by a thin line and the normal component of the magnetic force Fr is indicated by a thick line in the graph of FIG. 12.

In these graphs of FIGS. 11 and 12, a region where the normal component of the magnetic force Fr drawn by the thick line obtains positive values corresponds to the developer-releasing region P.

The horizontal axis of the graphs indicates angles of the normal component of the magnetic force Fr to the development sleeve 141, when assuming that the direction of rotation of the development sleeve 141 or the counterclockwise direction is a positive direction and that a local maximum point of the normal component of the magnetic flux density Hr of the magnetic pole S1 to the development sleeve 141 has an angle of 0 degree.

Figure 3:
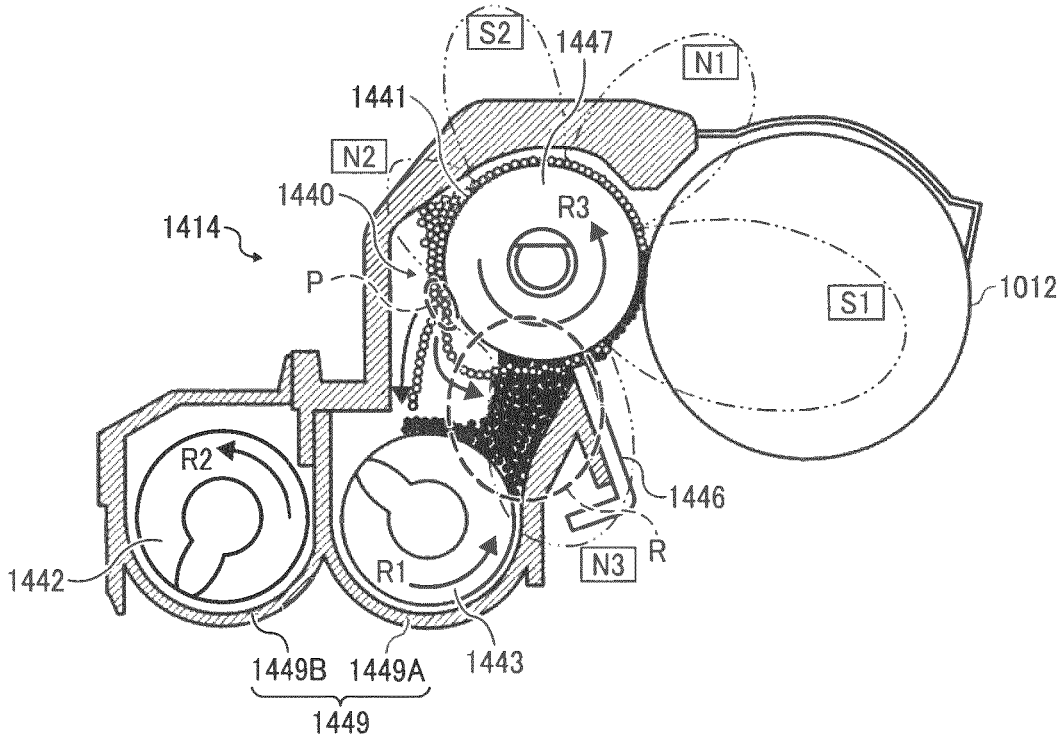
FIG. 3 BACKGROUND ART
FIG. 3 is a cross-sectional view of a schematic configuration of another modified example of a generally known developing unit.

The developing unit 1414 of FIG. 3 basically has a similar structure as the developing unit according to the conventional developing unit, except that the development sleeve 141 is shifted upward, and the developer-releasing region P located on the development sleeve 141 does not contact the developer stored in the developer storing chamber 149A while the developer sleeve 141 is rotating.

The comparative developing unit (the developing unit 1414 of FIG. 3) has a configuration in which the normal component of the magnetic force Fr serving as a release force in the developer-releasing region P has two local maximum points, as shown in the graph of FIG. 12, and a sharp fall or drop occurs between the two local maximum points to form a local minimum point therebetween. The degree of the sharp fall corresponds to approximately 25% of the normal component of the maximum magnetic force Fr to the developer-releasing region P, and thereby causing large loss or negative factors.

To eliminate the large loss, the present inventors conducted further researches and studies, and found the reason why the local minimum point of the normal component of the magnetic force Fr sharply dropped as shown in the graph of FIG. 12. Specifically, an additional north pole was disposed between the magnetic pole N2 and the magnetic pole N3 to prevent from causing any inversion of the normal component of the magnetic flux density Hr. If the normal component of the magnetic flux density Hr inverts, a reverse point may be generated to exert a force to attract the developer to the development sleeve 141. Therefore, the additional north pole was disposed between the magnetic pole N2 and the magnetic pole N3 to prevent the inversion of the normal component of the magnetic flux density Hr. The additional north pole was magnetized weaker than the magnetic poles N2 and N3, and therefore the normal component of the magnetic flux density Hr to the developer-releasing region P on the development sleeve 141 may be directed to the north pole or N-pole direction, which is a positive direction same as the direction of the magnetic pole N2 and the magnetic pole N3, across the developer-releasing region P and does not have the attraction force to attract the developer to the developer-releasing region P on the development sleeve 141.

However, the weak north pole could form a small local maximum point corresponding thereto, as shown in the graph of FIG. 12, and the present inventors found that this small local maximum point caused a significant drop of the local minimum point of the normal component of the magnetic force Fr.

Thus, as shown in FIG. 11, the developing unit 14 according to the exemplary embodiment of the present invention is designed such that the normal component of the magnetic flux density Hr to the developer-releasing region P on the development sleeve 141 is directed to the same positive direction as the magnetic pole N2 and the magnetic pole N3 across the developer-releasing region P and does not form the local maximum point.

Next, descriptions are given of examples of a manufacturing method of a magnetic roller 147 having a distribution of the normal component of the magnetic flux density as described above, referring to FIGS. 13 and 14.

Figure 13:
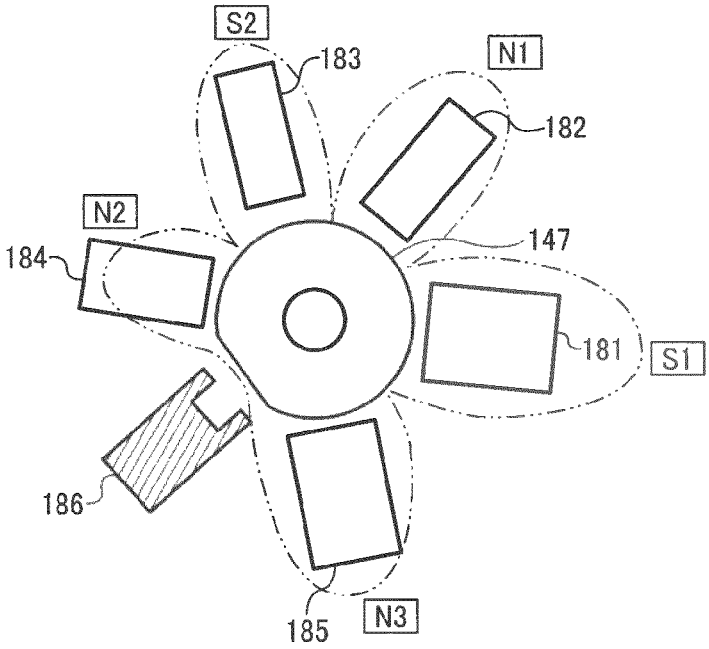
FIG. 13 is a schematic diagram for explaining a magnetizing process in manufacturing a magnetic roller of the developing unit according to an exemplary embodiment of the present invention.

FIG. 13 is a schematic diagram for explaining a magnetizing process in manufacturing the magnetic roller 147 of the developing unit 14 according to an exemplary embodiment of the present invention.

Figure 14:
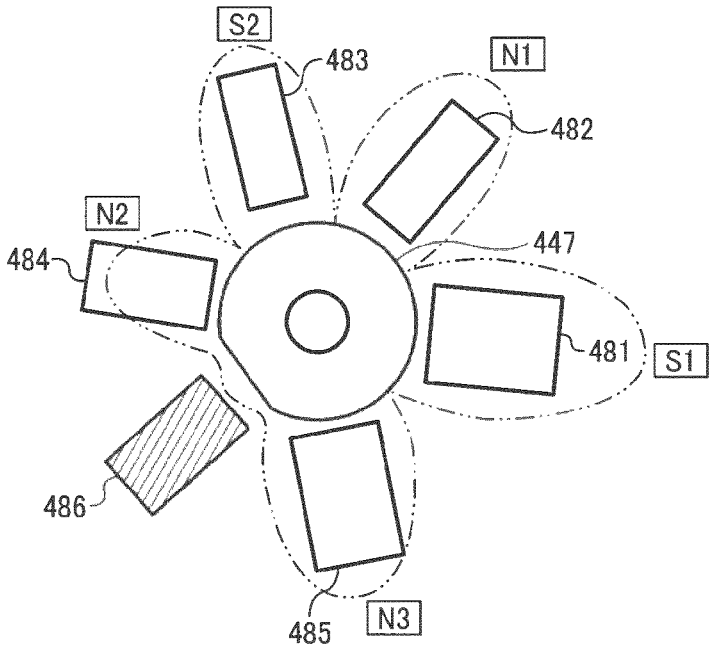
FIG. 14 is a schematic diagram for explaining a magnetizing process in manufacturing a magnetic roller of the comparative developing unit.

FIG. 14 is a schematic diagram for explaining a magnetizing process in manufacturing a magnetic roller 447 of the comparative developing unit.

The magnetic roller 147 is constituted as a cylindrical member of a resin mixed with magnetic powder and has a perimeter surface surrounded by or facing magnetizing yokes 181 to 186 so as to magnetize the exterior perimeter surface to form magnetic poles S1, N1, S2, N2, and N3 in this order. The magnetizing yokes 181 to 185 corresponding to the magnetic poles S1, N1, S2, N2, and N3 are different in size, shape, and intensity of magnetic force depending on each width of the corresponding magnetic pole and intensity of the corresponding magnetic field.

Similarly, the magnetic roller 447 is constituted as a cylindrical member of a resin mixed with magnetic powder and has a perimeter surface surrounded by or facing magnetizing yokes and 481 to 486 so as to magnetize the perimeter surface to form magnetic poles S1, N1, S2, N2, and N3 in this order. The magnetizing yokes 481 to 485 corresponding to the magnetic poles S1, N1, S2, N2, and N3 are different in size, shape, and intensity of magnetic force depending on each width of the corresponding magnetic pole and intensity of the corresponding magnetic field.

As shown in FIG. 14, the comparative developing unit forms the magnetizing yoke 486 between the magnetic pole N2 and the magnetic pole N3 to magnetize weaker than the magnetic pole N2 and the magnetic pole N3. Same as the other magnetizing yokes 481 to 485, the magnetizing yoke 486 has a flat surface that faces the perimeter surface of the magnetic roller 447, and therefore the center part of the flat surface thereof is most highly magnetized. With this reason, if the normal component of the magnetic flux density Hr to the developer-releasing region P on the development sleeve 141 is magnetized so as to surely be directed to the same positive direction as the magnetic pole N2 and the magnetic pole N3 across the developer-releasing region P, the local maximum point is formed as shown in the graph of FIG. 12 and as illustrated in FIG. 14.

By contrast, the developing unit 14 according to an exemplary embodiment of the present invention employs the magnetizing yoke 186 as shown in FIG. 13 so as to form a north pole between the magnetic pole N2 and the magnetic pole N3, which is magnetized weaker than the magnetic poles N2 and N3. Specifically, the magnetizing yoke 186 is arranged such that a surface thereof facing the magnetic roller 147 to be disposed farther from the exterior perimeter surface thereof than the surfaces of the magnetizing yokes 181 to 185. By arranging the surface of the magnetizing yoke 186 as described above, an amount of magnetization in the center part thereof can be smaller, and therefore the normal component of the magnetic flux density Hr to the developer-releasing region P on the development sleeve 141 can be magnetized to surely be directed to the same positive direction as the magnetic pole N2 and the magnetic pole N3 across the developer-releasing region P and the local maximum point may not be formed, as shown in the graph of FIG. 11 and as illustrated in FIG. 13.

The method of manufacturing the magnetic roller 147 describe The method of manufacturing the magnetic roller 147 described here is an example and is not limited to. The present invention can be applied to any other method capable of manufacturing a magnetic roller such that the normal component of the magnetic flux density Hr to the developer-releasing region P on the development sleeve 141 can be magnetized to surely be directed to the same positive direction as the magnetic pole N2 and the magnetic pole N3 across the developer-releasing region P and the local maximum point may not be formed therein.

Further, the present invention can be applied to the magnetic roller 147 and any other roller or member disposed such that the normal component of the magnetic flux density Hr to the developer-releasing region P on the development sleeve 141 can be magnetized to surely be directed to the same positive direction as the magnetic pole N2 and the magnetic pole N3 across the developer-releasing region P and the local maximum point may not be formed therein.

As previously described, the greater the local minimum point of the normal component of the magnetic force (i.e., the release force) Fr falls or drops, the greater the loss becomes when the developer is removed from the development sleeve 141 in the developer-releasing region P. As shown in the graph of FIG. 11, the developing unit 14 according to an exemplary embodiment of the present invention does not form the local maximum point to the normal component of the magnetic flux density Hr to the developer-releasing region P of the development sleeve 141, and therefore the normal component of the magnetic force Fr that has positive values can make the degree of the drop of the local minimum point smaller. Specifically, the normal component of the magnetic force Fr at the local minimum point is controlled to fall or drop to a certain level so that approximately 90% of the maximum values can be maintained. It is preferable that the degree of fall or drop can be reduced such that an amount of the normal component of the magnetic force (release force) Fr at the local minimum point is 50% or greater of the local maximum point. By so doing, the developing unit 14 according to the exemplary embodiment of the present invention can effectively reduce developer carryover and developer reattachment on the development sleeve 141 even if the developer in the developer storing chamber 149A does not scrape off the developer in the developer-releasing region P or act as the wall to prevent the developer reattachment to the development sleeve 141, thereby effectively preventing image quality deterioration caused by the above-described reasons.

The inventors of the present invention, which can be applied to solve the developer attachment, have found that the above-described developer reattachment is remarkably observed when a speed of the surface movement of the development sleeve 141 is 350 mm/sec or greater. The present invention can achieve a significant effect under the above-described condition.

The developing unit 14 according to the exemplary embodiment, the developing roller 140 includes the magnet 155 that serves as a repulsive magnetic field generator. The magnet 155 is disposed between the magnetic pole N2 and the magnetic pole N3 as shown in FIG. 10.

Figure 15:
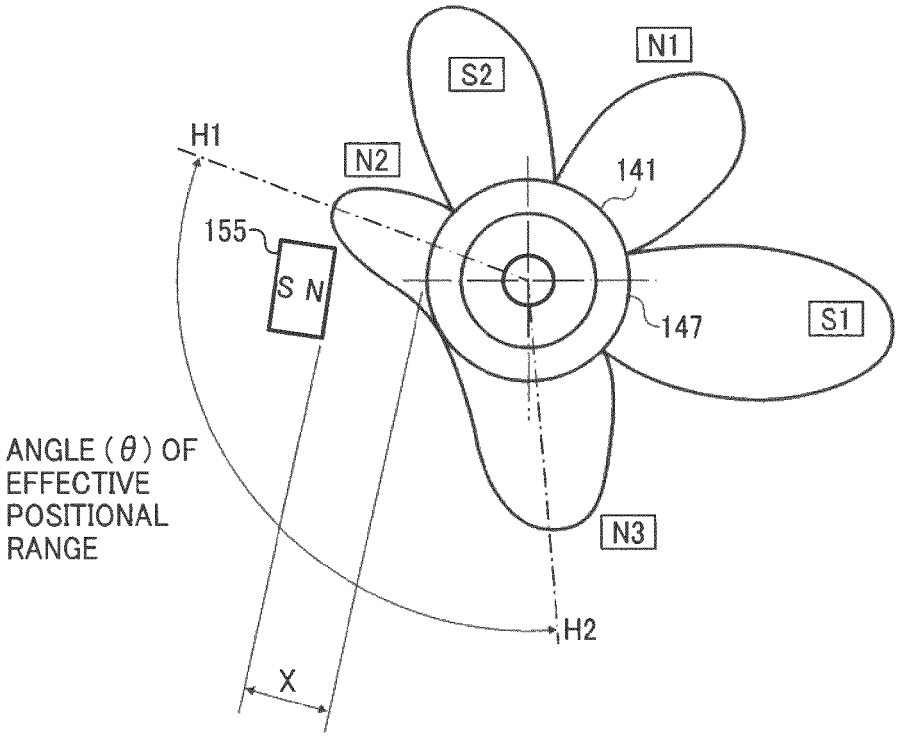
FIG. 15 is a drawing showing a position of a magnet with respect to the development sleeve according to an exemplary embodiment of the present invention.
Figure 16:
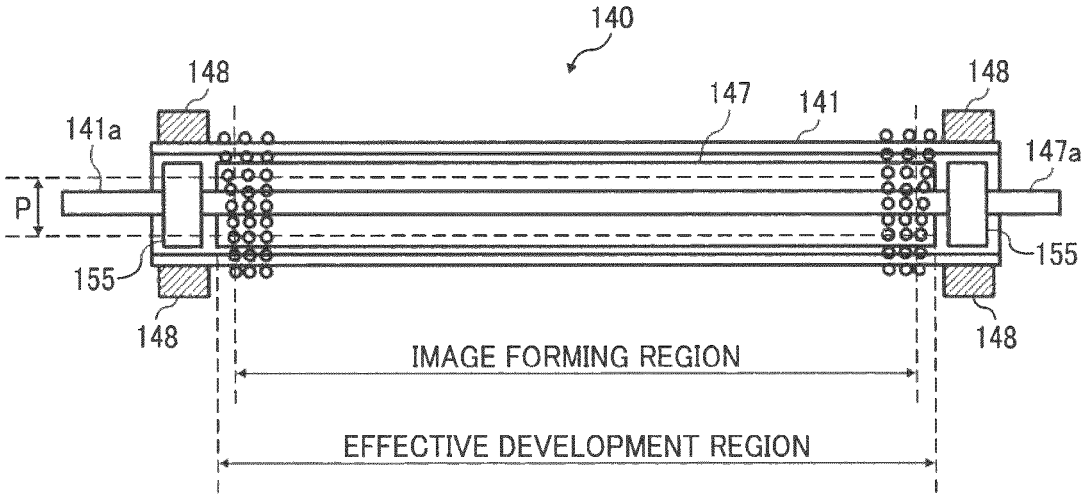
FIG. 16 is a drawing showing the position of the magnet of FIG. 15, viewed in an axial direction of the development sleeve.

For details, a description is given to a positional relation of the magnet 155 with respect to the magnetic poles of the development sleeve 141 with reference to FIGS. 15 and 16. FIG. 15 is a drawing to show the position of the magnet 155, viewed from one end of the development sleeve 141 along the direction of conveyance of developer by the development sleeve 141. FIG. 16 is a drawing to show the position of the magnet 155, viewed along a longitudinal or axial direction of the developing roller 140.

As illustrated in FIG. 15, the magnet 155 may be disposed at a position within an effective positional range with a given angle θ, which is a range between a normal line H1 to the local maximum point of the normal component of the magnetic flux density Hr of the magnetic pole N2 and a normal line H2 to the local maximum point of the normal component of the magnetic flux density Hr of the magnetic pole N3.

Also as illustrated in FIG. 16, the magnet 155 includes two magnets 155, each of which is disposed outside an opposed region of the effective development region of the magnetic roller 147 or an image forming region facing the magnetic roller 147 in the axial direction of the development sleeve 141. Each magnet 155 is disposed such that the magnetic pole face with the north pole same as the magnetic poles N2 and N3 is directed to the developer-releasing region P.

When the above-described magnet 155 is not incorporated, the previously described developer carryover and developer reattachment on the development sleeve 141 can occur in each end region in a direction along a shaft 141*a* of the development sleeve 141 in the opposed region of the effective development region of the magnetic roller 147 on the exterior perimeter surface of the development sleeve 141. Such a phenomenon may occur since, in the developer-releasing region P, magnetic field lines generated in the end region in the axial direction of the development sleeve 141 in the opposed region of the magnetic roller 147 may direct to the outside in the axial direction of the development sleeve 141. Therefore, the magnetic force exerting on the developer in the end regions has components directing toward the outside in the axial direction of the development sleeve 141. Therefore, the magnetic force serving as a release force cannot effectively exert the release force on the developer, and thereby causing the developer carryover and/or developer reattachment on the development sleeve 141.

Since the development sleeve 141 and the magnetic roller 147 are coaxially and integrally mounted as the developer roller 140, the shaft 141*a* of the development sleeve 141 corresponds to a shaft 147*a* of the magnetic roller 147.

As previously described, the configuration according to this exemplary embodiment of the present invention includes the magnet 155. Therefore, in the developer-releasing region P on the development sleeve 141, a direction of magnetic field lines in the each end region in the axial direction of the development sleeve 141 in a region opposite to the magnetic roller 147 can be close to a direction perpendicular to the direction of the shaft 141*a* of the development sleeve 141. This can increase in the release force in the end regions, which can cause the release force to be effectively exerted on the developer even in the end regions, so as to remove the developer from the outer perimeter surface of the development sleeve 141. As a result, the developer carryover and/or developer reattachment can be effectively reduced even in the end regions.

A magnetic pole face, which is the north pole face of the magnet 155, can be disposed at each end region of the magnetic roller 147 across the development sleeve 141 in the axial direction thereof. In this case, however, a part of the magnetic pole face disposed outside the end regions of the magnetic roller 147 may be arranged to generate a magnetic field greater than a different part of the magnetic pole face disposed inside the end regions of the magnetic roller 147 (i.e., a magnetic pole face facing the opposed region of the magnetic roller 147). For example, if the N-pole face of the magnet 155 has a magnetic force evenly on the N-pole face, the magnetic pole face of the magnet 155 can be arranged such that a part disposed outside the end regions of the magnetic roller 147 has area wider than other part disposed inside the end regions of the magnetic roller 147. With this configuration, even if the N-pole face of the magnet 155 is disposed across each end region of the magnetic roller 147 in the axial direction of the development sleeve 141, the direction of magnetic field lines at each end region of the magnetic roller 147 can be directed closer to a direction perpendicular to the axial direction of the development sleeve 141.

However, as described in the first exemplary embodiment, the configuration in which the N-pole face of the magnet 155 is disposed other than a position that faces the opposed region of the magnetic roller 147 is more effective to cause the direction of the magnetic field lines to make close to the direction perpendicular to the axis of the development sleeve 141, and therefore developer carryover can be reduced or prevented effectively.

Further, the developing unit 14 includes a seal member 148 to seal or eliminate space between the perimeter surface of the development sleeve 141 and the casing 144 of the developing unit 14. As shown in FIG. 15, the seal member 148 is disposed in a range between the normal line H1 to the local maximum point of the normal component of the magnetic flux density Hr of the magnetic pole N2 and the normal line H2 to the local maximum point of the normal component of the magnetic flux density Hr of the magnetic pole N3 in the developer conveyance direction of the development sleeve 141, which is within a range with a given angle indicated in FIG. 15. That is, the seal member 148 is disposed at each position outside the effective development range that covers the image forming region on the photoconductor drum 12 shown in FIG. 16. In the exemplary embodiment of the present invention, the whole N-pole face of the magnet 155 is disposed outside an inner surface of the seal member 148 in the axial direction of the development sleeve 141. With this configuration, even if the magnet 155 is disposed at the position, it can prevent that the developer in the developer container 149 is accumulated therein due to the magnetic force of the magnet 155.

Further, in the exemplary embodiment, the N-pole face of the magnet 155 is disposed so as to face the exterior perimeter surface of the development sleeve 141. However, the N-pole surface is not necessarily or limited to be disposed as above. For example, the N-pole face of the magnet 155 an be disposed outside the end region of the axis of the development sleeve 141 along the axis of the development sleeve 141. Specifically, for example, the magnet 155 can be disposed at the outer surface of the seal member 148 such that the N-pole face faces toward the center part of the axis of the development sleeve 141. Even with this configuration, the direction of magnetic field lines in each end region of the magnetic roller 147 in the axial direction of the development sleeve 141 can be close to a direction perpendicular to the axial direction of the development sleeve 141.

Further, in the exemplary embodiment, a minimum distance "X" (see FIG. 15) between the N-pole face of the magnet 155 and the exterior perimeter surface of the development sleeve 141 is designed to become greater than the height or thickness of layer of the developer held on the exterior perimeter surface of the development sleeve 141. With this configuration, the developer carried on the developer sleeve 141 may not be affected to move or release therefrom due to the magnetic force generated by the magnet 155 while the development sleeve 141 is rotating, and therefore a targeted effect such as developer removal or release can be obtained without causing any problem.

Figure 17:
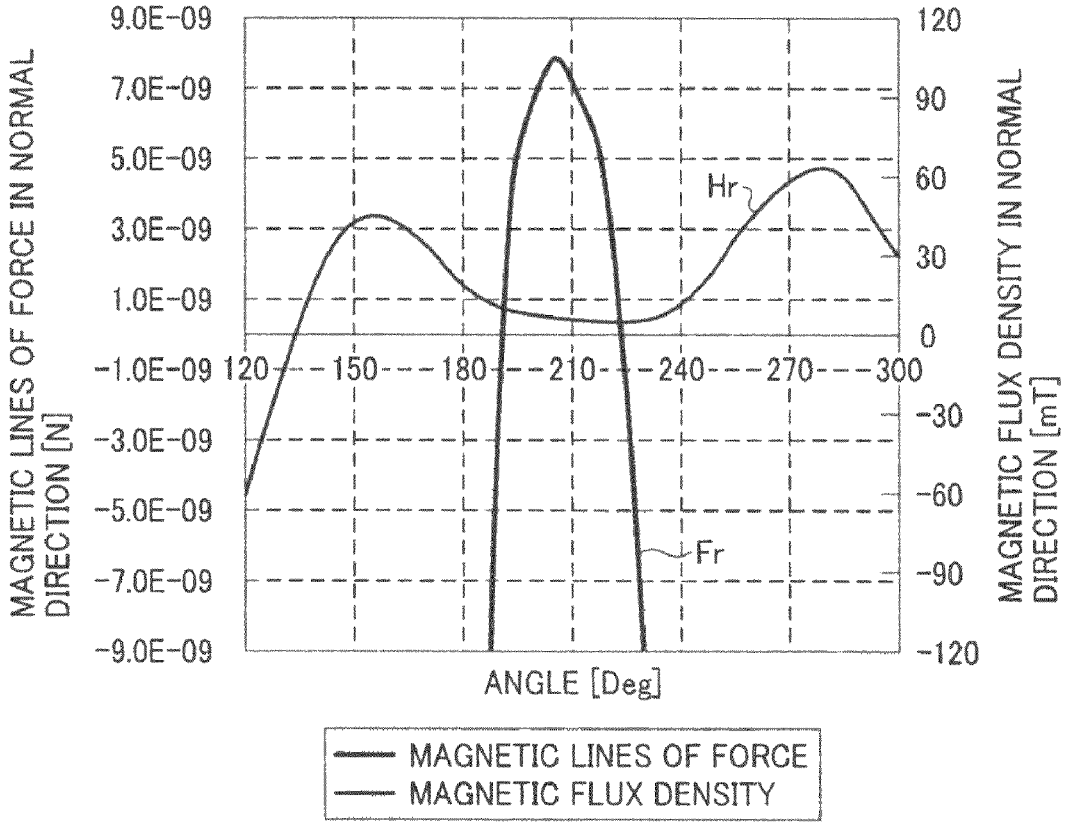
FIG. 17 is a graph showing a relation between a magnetic flux density in a direction normal to a developer releasing region on the development sleeve and a magnetic force in a direction normal to the surface of the development sleeve in the developing unit according to a modified example of the present invention.

Next, a description is given of a first modified example of a relation between a normal component of the magnetic flux density and a normal component of the magnetic force with respect to a surface of a development sleeve, referring to graphs shown in FIG. 17.

FIG. 17 is a graph showing a relation between a normal component of the magnetic flux density Hr to a surface of the development sleeve 141 around the developer-releasing region P and a normal component of the magnetic force Fr to the surface of the development sleeve 141 of the developing unit 14 according to the first modified example of the present invention. The normal component of the magnetic flux density Hr is indicated by a thin line and the normal component of the magnetic force Fr is indicated by a thick line in the graph of FIG. 17.

As shown in the graph of FIG. 17, the developing unit 14 according to the first modified example of the present invention can include a configuration such that the normal component of the magnetic force (release force) Fr in the developer-releasing region P has a single local maximum point. Specifically, the magnetizing process of each magnetic pole provided to the magnetic roller 147 can be adjusted so that the normal component of the magnetic force (release force) Fr in the developer-releasing region P has a single local maximum point. With this configuration, the normal component of the magnetic force (release force) Fr may not form its local minimum point, and thereby not causing a fall or drop temporarily. Therefore, this configuration according to the first modified example can reduce or minimize the loss caused when removing the developer from the development sleeve 141 in the developer-releasing region P, and thus can effectively prevent image quality deterioration.

Figure 18A:
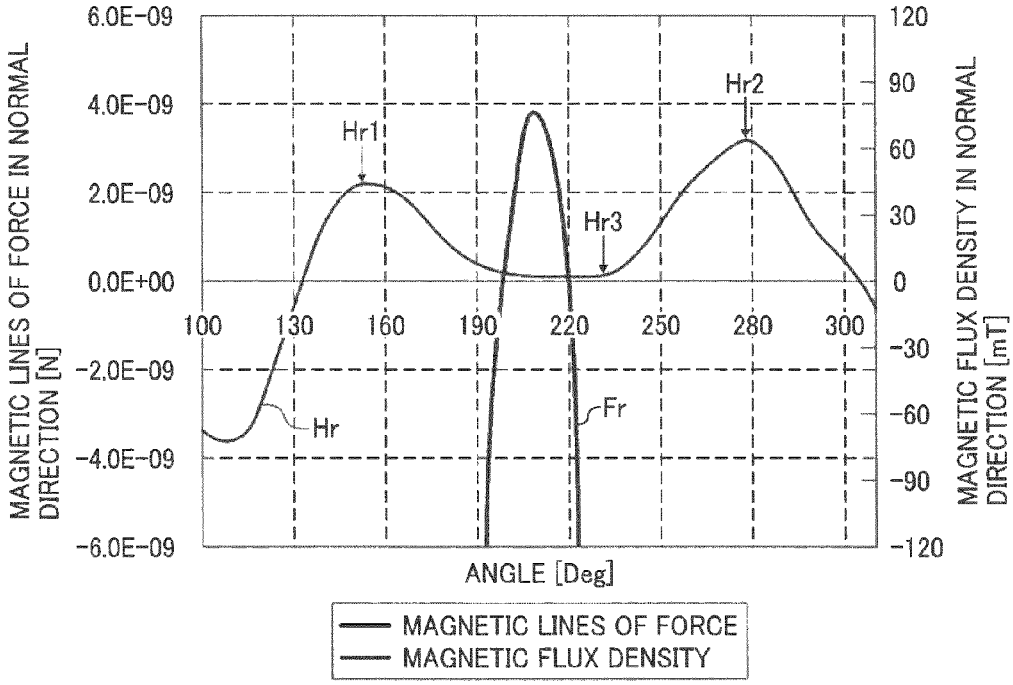
FIG. 18A is a graph showing a relation between a magnetic flux density in a direction normal to a developer releasing region on the development sleeve and a magnetic force in a direction normal to the surface of the development sleeve in the developing unit according to another modified example of the present invention.
Figure 18B:
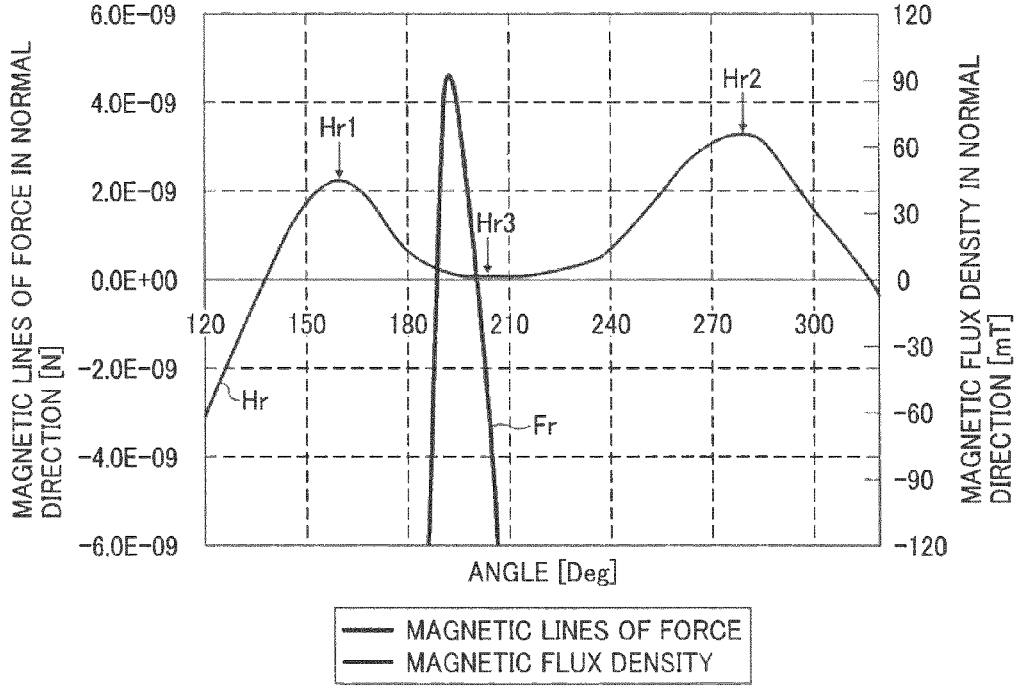
FIG. 18B is a graph showing a relation between a magnetic flux density in a direction normal to a developer releasing region on the development sleeve and a magnetic force in a direction normal to the surface of the development sleeve in a comparative developing unit with respect to the developing unit of FIG. 18A.

Next, a description is given of a second modified example of a relation between normal components of the magnetic flux density Hr and normal components of the magnetic force Fr with respect to respective surfaces of two different development sleeves, referring to graphs shown in FIGS. 18A and 18B.

FIG. 18A is a graph showing a relation between a normal component of the magnetic flux density Hr to a surface of the development sleeve 141 around the developer-releasing region P and a normal component of the magnetic force Fr to the surface of the development sleeve 141 of the developing unit 14 according to the second modified example of the present invention. The normal component of the magnetic flux density Hr is indicated by a thin line and the normal component of the magnetic force Fr is indicated by a thick line in the graph of FIG. 18A.

Similarly to the graph of FIG. 18A, FIG. 18B is a graph showing a relation between a normal component of the magnetic flux density Hr to a surface of the development sleeve 141 around the developer-releasing region P and a normal component of the magnetic force Fr to the surface of the development sleeve 141 of a developing unit according to a comparative example to the second modified example. The normal component of the magnetic flux density Hr is indicated by a thin line and the normal component of the magnetic force Fr is indicated by a thick line in the graph of FIG. 18B.

In FIGS. 18A and 18B, "Hr1" represents a first local maximum point where the normal component of the magnetic flux density Hr of the magnetic pole N2 reaches a maximum on the development sleeve 141 in the developer conveyance direction of the development sleeve 141, "Hr2" represents a second local maximum point where the normal component of the magnetic flux density Hr of the magnetic pole N3 reaches a maximum on the development sleeve 141 in the developer conveyance direction of the development sleeve 141, and "Hr3" represents a local minimum point where the normal component of the magnetic flux density Hr to the development sleeve 141 between the first local maximum point Hr1 and the second local maximum point Hr2 reaches a minimum on the development sleeve 141.

As shown in the graph of FIGS. 18A, the local minimum point Hr3 can be located closer to the second local maximum point Hr2 than to the first local maximum point Hr1 from a center point between the first local maximum point Hr1 and the second local maximum point Hr2. This arrangement can locate the developer-releasing region P close to the magnetic pole N3, thereby reducing reattachment of the removed developer to the developer sleeve 141.

As described above, each of the developing units 14Y, 14C, 14M, and 14K according to the exemplary embodiments including the modified examples (hereinafter, referred to simply as the "exemplary embodiments") includes the developing roller 140 serving as a developer bearing member, the developer container 149, conveyance screws 142 and 143 serving as agitation/conveyance members, and a doctor blade 146 serving as a developer regulating member. The developing roller 140 includes a magnetic roller 147 serving as a magnetic generator and a development sleeve 141 serving as a nonmagnetic hollow body containing the magnetic roller 147 to bear a two-component developer including magnetic carrier particles and toner particles on an exterior perimeter surface thereof by a magnetic force generated by the magnetic roller 147. The developer container 149 is disposed adjacent to the developing roller 140 and includes the developer storing chamber 149A to store the two-component developer therein. The conveyance screws 142 and 143 are disposed in the developer container 149 to convey the two-component developer in an axial direction of the development sleeve 141 of the developing roller 140 while agitating the two-component developer. The doctor blade 146 is disposed opposite the developing roller 140 to regulate the thickness of a layer of the two-component developer held on the development sleeve 141 of the developing roller 140. The two-component developer conveyed in the developer container 149 is attracted by the magnetic force exerted by the magnetic roller 147 to the developer bearing member, is regulated by the doctor blade 146, then passes through a development region of the development sleeve 141 of the developing roller 140 facing a corresponding one of the photoconductor drums 12Y, 12C, 12M, and 12K, and returns to the developer container 149. The magnetic roller 147 includes the magnetic pole N2 serving as a first magnetic pole and the magnetic pole N3 serving as a second magnetic pole with an identical polarity (north pole or N-pole) disposed adjacent to each other and downstream from the development region in a direction of rotation of the developing roller 140 to generate respective magnetic forces for removing the two-component developer from the development sleeve 141 of the developing roller 140 after the developer passes through the development region. The magnetic pole N3 is disposed downstream from the magnetic pole N2 in a direction of conveyance of developer by the development sleeve 141 of the developing roller 140 and proximate to the doctor blade 146 to generate a magnetic force to attract the two-component developer from the developer storing chamber 149A in the developer container 149 for forming a magnetic brush of the two-component developer on the development sleeve 141 of the developing roller 140 regulated by the doctor blade 146. In the developing unit 14, the development sleeve 141 of the developing roller 140 includes the developer-releasing region P to release the two-component developer from the development sleeve 141 of the developing roller 140 using a release force (the magnetic force in the normal direction with a positive value) corresponding to magnetic forces generated by the magnetic poles N2 and N3. The developer is disposed higher than a top surface of the two-component developer stored in the developer storing chamber 149A of the developer container 149 so that the developer-releasing region P formed on the development sleeve 141 remains separated from the top surface of the two-component developer in the developer storing chamber 149A as the development sleeve 141 rotates. The magnetic roller 147 is disposed such that a component of a magnetic flux density of the magnetic field generated by the magnetic roller 147 in a direction normal to the developer-releasing region P on the development sleeve 141 of the developing roller 140 is directed to a same positive direction (with positive values) as the magnetic poles N2 and N3 across the developer-releasing region P without forming a local maximum point. As previously described, this configuration can reduce the fall or drop of the local minimum point of the magnetic force in the normal direction Fr (i.e., the release force), which can be loss when the developer is released from the development sleeve 141 in the developer-releasing region P. Therefore, even if the developer in the developer storing chamber 149A does not scrape off the developer in the developer-releasing region P or act as a wall to prevent developer attachment to the development sleeve 141, the developing unit 14 according to the exemplary embodiments can effectively reduce developer carryover and developer reattachment on the development sleeve 141 of the developing roller 140, and therefore can effectively prevent image quality degradation caused by the above-described reasons.

Further, as shown in FIG. 11, the magnetic roller 147 can be disposed such that the release force exerted on the two-component developer in the developer-releasing region P on the development sleeve 141 has two local maximum points, and the magnetic force in the normal direction (the release force) Fr at a local minimum point between the two local maximum points is at least 50% as strong as the release force at the local maximum point. This configuration of the developing unit 14 according to the exemplary embodiments can effectively reduce developer carryover and developer reattachment on the development sleeve 141 of the developing roller 140, and therefore can effectively prevent image quality degradation caused by the development carryover and/or development reattachment.

Further, as shown in the first modified example, the magnetic roller 147 can be disposed such that the release force exerted on the developer in the developer-releasing region P on the development sleeve 141 of the developing roller 140 has a single local maximum point. Since the local minimum point cannot be formed with this configuration, the developing unit 14 according to the exemplary embodiments can reduce developer carryover and developer reattachment on the development sleeve 141 of the developing roller 140 more effectively, and therefore can effectively prevent image quality degradation caused by the development carryover and/or development reattachment.

Further, as shown in the second modified example, the developer-releasing region P on the development sleeve 141 of the developing roller 140 can include the first local maximum point Hr1 where the magnetic flux density in the normal direction Hr of the magnetic pole N2 reaches a maximum on the development sleeve 141 in the direction of conveyance of developer thereon, the second local maximum point Hr2 where the magnetic flux density in the normal direction Hr of the magnetic pole N3 reaches a maximum on the development sleeve 141 in the direction of conveyance of developer thereon, and the local minimum point Hr3 where the magnetic flux density in the normal direction Hr to the development sleeve 141 reaches a minimum on the development sleeve 141. The magnetic roller 147 may be disposed such that the local minimum point Hr3 is located closer to the second local maximum point Hr2 than to the first local maximum point Hr1 from a center point between the first local maximum point Hr1 and the second local maximum point Hr2. Therefore, the developing unit 14 can reduce reattachment of the removed developer to the developer sleeve 141.

Further, in the exemplary embodiments, the speed of surface movement of the development sleeve 141 is 350 mm/sec or greater, which may generally cause developer reattachment to the development sleeve 141 of the developing roller 140. However, by employing the above-described configuration, the developer reattachment can be prevented effectively, and therefore can be effectively prevent image quality degradation caused by the developer reattachment in high-speed image forming apparatuses.

Further, in the exemplary embodiments, multiple elliptic dents are formed randomly on the exterior perimeter surface of the development sleeve 141 of the developing roller 140. Therefore, as previously described, a good image with stable quality can be obtained without generating uneven image over an extended period of time.

Further, in the exemplary embodiments, the volume average particle diameter of each of the magnetic carrier particles is approximately 20 μm to approximately 50 μm, and therefore a good image with stable graininess can be obtained over an extended period of time.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. A developing unit, comprising:

a developer bearing member to bear a two-component developer including magnetic carrier particles and toner particles on a surface thereof, the developer bearing member including:

a magnetic field generator; and a nonmagnetic hollow body containing the magnetic field generator for bearing the two-component developer on an exterior perimeter surface thereof by a magnetic force generated by the magnetic field generator;

a developer container disposed adjacent to the developer bearing member, including a developer storing chamber to store the two-component developer therein;

an agitation/conveyance member disposed in the developer container to convey the two-component developer in an axial direction of the developer bearing member while agitating the two-component developer; and a developer regulating member disposed opposite the developer bearing member to regulate the thickness of a layer of the two-component developer held on the developer bearing member, wherein the two-component developer conveyed in the developer container is attracted by the magnetic force exerted by the magnetic field generator to the developer bearing member, is regulated by the developer regulating member, then passes through a development region of the developer bearing member facing an image bearing member, and returns to the developer container, the magnetic field generator including first and second magnetic poles with an identical polarity disposed adjacent to each other and downstream from the development region in a direction of rotation of the developer bearing member to generate respective magnetic forces for removing the two-component developer from the developer bearing member after the two-component developer passes through the development region, the second magnetic pole disposed downstream from the first magnetic pole in a direction of conveyance of developer by the developer bearing member and proximate to the developer regulating member to generate a magnetic force to attract the two-component developer from the developer storing chamber in the developer container for forming a magnetic brush of the two-component developer on the developer bearing member regulated by the developer bearing member, the developer bearing member including a developer-releasing region to release the two-component developer from the developer bearing member using a release force corresponding to magnetic forces generated by the first and second magnetic poles, the magnetic field generator being disposed such that the release force exerted on the two-component developer in the developer-releasing region on the developer bearing member has a single local maximum point, the developer bearing member being disposed higher than a top surface of the two-component developer stored in the developer storing chamber so that the developer-releasing region on the developer bearing member remains separated from the top surface of the two-component developer in the developer storing chamber as the developer bearing member rotates, a component of a magnetic flux density of the magnetic field generated by the magnetic field generator in a direction normal to the developer-releasing region on the developer bearing member being directed to a same direction as the first and second magnetic poles across the developer-releasing region without forming a local maximum point.

2. The developing unit according to claim 1, wherein the magnetic field generator is disposed such that the release force exerted on the two-component developer in the developer-releasing region on the developer bearing member has two local maximum points, and a release force at a local minimum point between the two local maximum points is at least 50% as strong as a release force at one of the local maximum points.

3. The developing unit according to claim 1, wherein the developer-releasing region on the developer bearing member includes a first point where the magnetic flux density in a normal direction of the first magnetic pole reaches a maximum on the developer bearing member in the direction of conveyance of developer thereon, a second point where the magnetic flux density in a normal direction of the second magnetic pole reaches a maximum on the developer bearing member in the direction of conveyance of developer thereon, and a third point represents a point where the magnetic flux density in a direction normal to the developer bearing member reaches a minimum on the developer bearing member, the magnetic field generator being disposed such that the third point, which is between the first point and the second point, is located closer to the second point than to the first point.

4. The developing unit according to claim 1, wherein a speed of surface movement of the nonmagnetic hollow body is 350 mm/sec or greater.

5. The developing unit according to claim 1, wherein multiple elliptic dents are formed randomly on the exterior perimeter surface of the nonmagnetic hollow body of the developer bearing member.

6. The developing unit according to claim 1, wherein the volume average particle diameter of each of the magnetic carrier particles is 20 μm to 50 μm.

7. An image forming apparatus, comprising:

an image bearing member to bear an image on a surface thereof; and the developing unit according to claim 1, the developing unit disposed facing the image bearing member to convey and adhere the two-component developer to the image for developing a toner image to be transferred from the image bearing member onto a recording medium.

8. The image forming apparatus according to claim 7, wherein the magnetic field generator is disposed such that the release force exerted on the two-component developer in the developer-releasing region on the developer bearing member has two local maximum points, and a release force at a local minimum point between the two local maximum points is at least 50% as strong as a release force at one of the local maximum points.

9. The image forming apparatus according to claim 7, wherein the magnetic field generator is disposed such that the release force exerted on the two-component developer in the developer-releasing region on the developer bearing member has a single local maximum point.

10. The image forming apparatus according to claim 7, wherein the developer-releasing region on the developer bearing member includes a first point where the magnetic flux density in a normal direction of the first magnetic pole reaches a maximum on the developer bearing member in the direction of conveyance of developer thereon, a second point where the magnetic flux density in a normal direction of the second magnetic pole reaches a maximum on the developer bearing member in the direction of conveyance of developer thereon, and a third point represents a point where the magnetic flux density in a direction normal to the developer bearing member reaches a minimum on the developer bearing member, the magnetic field generator being disposed such that the third point, which is between the first point and the second point, is located closer to the second point than to the first point.

11. The image forming apparatus according to claim 7, wherein a speed of surface movement of the nonmagnetic hollow body is 350 mm/sec or greater.

12. The image forming apparatus according to claim 7, wherein multiple elliptic dents are formed randomly on the exterior perimeter surface of the nonmagnetic hollow body of the developer bearing member.

13. The image forming apparatus according to claim 7, wherein the volume average particle diameter of each of the magnetic carrier particles is 20 μm to 50 μm.

14. A process cartridge detachably attachable to an image forming apparatus, the process cartridge comprising:

an image bearing member to bear an image on a surface thereof; and the developing unit according to claim 1, the image bearing member and the developing unit integrally supported by the process cartridge, the developing unit disposed facing the image bearing member to convey and adhere the two-component developer to the image for developing a toner image to be transferred from the image bearing member onto a recording medium.

15. A developing unit, comprising:

a developer bearing member to bear a two-component developer including magnetic carrier particles and toner particles on a surface thereof, the developer bearing member including:

a magnetic field generator; and a nonmagnetic hollow body containing the magnetic field generator for bearing the two-component developer on an exterior perimeter surface thereof by a magnetic force generated by the magnetic field generator;

a developer container disposed adjacent to the developer bearing member, including a developer storing chamber to store the two-component developer therein;

an agitation/conveyance member disposed in the developer container to convey the two-component developer in an axial direction of the developer bearing member while agitating the two-component developer; and a developer regulating member disposed opposite the developer bearing member to regulate the thickness of a layer of the two-component developer held on the developer bearing member, wherein the two-component developer conveyed in the developer container is attracted by the magnetic force exerted by the magnetic field generator to the developer bearing member, is regulated by the developer regulating member, then passes through a development region of the developer bearing member facing an image bearing member, and returns to the developer container, the magnetic field generator including first and second magnetic poles with an identical polarity disposed adjacent to each other and downstream from the development region in a direction of rotation of the developer bearing member to generate respective magnetic forces for removing the two-component developer from the developer bearing member after the two-component developer passes through the development region, the developer bearing member including a developer-releasing region to release the two-component developer from the developer bearing member using a release force corresponding to magnetic forces generated by the first and second magnetic poles, the magnetic field generator being disposed such that the release force exerted on the two-component developer in the developer-releasing region on the developer bearing member has a single local maximum point, the developer bearing member being disposed above the agitation/conveyance member so that the developer-releasing region on the developer bearing member remains separated from the agitation/conveyance member as the developer bearing member rotates.

16. The developing unit according to claim 15, wherein a component of a magnetic flux density of the magnetic field generated by the magnetic field generator in a direction normal to the developer-releasing region on the developer bearing member is directed to a same direction as the first and second magnetic poles across the developer-releasing region without forming a local maximum point.

17. The developing unit according to claim 16, wherein the second magnetic pole is disposed downstream from the first magnetic pole in a direction of conveyance of developer by the developer bearing member and proximate to the developer regulating member to generate a magnetic force to attract the two-component developer from the developer storing chamber in the developer container for forming a magnetic brush of the two-component developer on the developer bearing member regulated by the developer bearing member.

18. The developing unit according to claim 15, wherein the magnetic field generator is disposed such that the release force exerted on the two-component developer in the developer-releasing region on the developer bearing member has two local maximum points, and a release force at a local minimum point between the two local maximum points is at least 50% as strong as a release force at one of the local maximum points.

19. The developing unit according to claim 15, wherein the developer-releasing region on the developer bearing member includes a first point where the magnetic flux density in a normal direction of the first magnetic pole reaches a maximum on the developer bearing member in the direction of conveyance of developer thereon, a second point where the magnetic flux density in a normal direction of the second magnetic pole reaches a maximum on the developer bearing member in the direction of conveyance of developer thereon, and a third point represents a point where the magnetic flux density in a direction normal to the developer bearing member reaches a minimum on the developer bearing member, and the magnetic field generator is disposed such that the third point, which is between the first point and the second point, is located closer to the second point than to the first point.

20. The developing unit according to claim 15, wherein a speed of surface movement of the nonmagnetic hollow body is 350 mm/sec or greater.

21. The developing unit according to claim 15, wherein multiple elliptic dents are formed randomly on the exterior perimeter surface of the nonmagnetic hollow body of the developer bearing member.

22. The developing unit according to claim 15, wherein the volume average particle diameter of each of the magnetic carrier particles is 20 μm to 50 μm.

23. An image forming apparatus, comprising:

an image bearing member to bear an image on a surface thereof; and the developing unit according to claim 15, the developing unit disposed facing the image bearing member to convey and adhere the two-component developer to the image for developing a toner image to be transferred from the image bearing member onto a recording medium.

* * * * *